US008602214B2

(12) United States Patent
Raming

(10) Patent No.: US 8,602,214 B2
(45) Date of Patent: Dec. 10, 2013

(54) MULTIPLE PLY LABEL WITH ADHESIVE LAYERS

(75) Inventor: Bruce Raming, Northbrook, IL (US)

(73) Assignee: Premier Print & Services Group, Inc., Chicago, IL (US)

( * ) Notice: Subject to any disclaimer, the term of this patent is extended or adjusted under 35 U.S.C. 154(b) by 234 days.

(21) Appl. No.: 13/047,328

(22) Filed: Mar. 14, 2011

(65) Prior Publication Data

US 2012/0234481 A1 Sep. 20, 2012

(51) Int. Cl.
*B42D 15/00* (2006.01)

(52) U.S. Cl.
USPC ..... 206/459.5; 206/484; 283/94; 283/901

(58) Field of Classification Search
USPC ..... 206/459.5, 484; 283/81, 94, 101, 105, 283/901; 229/901
See application file for complete search history.

(56) References Cited

U.S. PATENT DOCUMENTS

| | | | |
|---|---|---|---|
| 4,544,590 | A | 10/1985 | Egan |
| 5,340,158 | A | 8/1994 | Bartl |
| 5,547,227 | A | 8/1996 | Laurash et al. |
| 5,716,688 | A | 2/1998 | Burke et al. |
| 5,735,549 | A | 4/1998 | Konkol et al. |
| 6,152,357 | A | 11/2000 | Scnitzer |
| 6,186,554 | B1 | 2/2001 | Raming |
| 6,213,518 | B1 | 4/2001 | Raming |
| 6,616,189 | B2 | 9/2003 | Raming |
| 6,953,207 | B2 | 10/2005 | Raming |
| RE38,976 | E | 2/2006 | Raming |
| RE39,100 | E | 5/2006 | Raming |
| 7,891,490 | B2 | 2/2011 | Raming |
| 8,096,418 | B2 | 1/2012 | Raming |

*Primary Examiner* — Jacob K Ackun
(74) *Attorney, Agent, or Firm* — Hovey Williams LLP

(57) ABSTRACT

A label is operable to be adhesively applied to a substrate to carry publicly displayed indicia on one side and hidden indicia on a second, opposite side. The label includes top and bottom label plies, with the top label ply having the publicly displayed indicia and the bottom label ply having the hidden indicia. The top label ply has a top adhesive layer applied thereon, and the bottom label ply has a bottom adhesive layer applied thereon.

22 Claims, 21 Drawing Sheets

MULTIPLE PLY LABEL WITH ADHESIVE LAYERS

BACKGROUND

1. Field

The present invention relates generally to multiple ply labels. More specifically, embodiments of the present invention concern a multiple ply label including top and bottom label plies, with top and bottom adhesive layers being applied between the label plies.

2. Discussion of Prior Art

Many types of business forms are designed to be adhesively attached to a substrate, such as a product or a product container. For instance, shipping labels are often adhered directly to a box, envelope, or other packaging for shipping a product. Conventional shipping and packing labels are provided as separate labels for each shipping package, with the packing label normally being held by the shipping label so that the contents indicia printed on the packing label are hidden from view. Some prior art shipping labels have been produced in the form of a duplex printed label with shipping indicia on one side and package contents indicia on the other side, and these labels are printed by a conventional duplex printer. The duplex label is also affixed to the package so that the contents indicia is hidden.

Conventional adhesive business forms, including adhesive shipping labels, suffer from various undesirable limitations. For example, conventional labels fail to efficiently use space on a package surface while being configured for efficient printing and package application.

SUMMARY

The following brief summary is provided to indicate the nature of the subject matter disclosed herein. While certain aspects of the present invention are described below, the summary is not intended to limit the scope of the present invention.

Embodiments of the present invention provide a label that does not suffer from the problems and limitations of the prior art labels set forth above.

A first aspect of the present invention concerns a label operable to be adhesively applied to a substrate to carry publicly displayed indicia on one side and hidden indicia on a second, opposite side. The label broadly includes unfolded top and bottom label plies, with each ply including top and bottom faces and a face outer edge, with the bottom face of the top label ply and the top face of the bottom label ply being opposed when the label plies are adhered relative to each other. The top label ply has the publicly displayed indicia printed thereon. The bottom label ply includes a line of separation located inboard of the face outer edge to present a removable central portion, with the central portion of the bottom label ply having the hidden indicia printed thereon. The bottom label ply further includes a removable border portion defined between the face outer edge and the line of separation. The bottom face of the top label ply includes a top adhesive region, with a top adhesive layer being applied along the top adhesive region and the bottom label ply being in overlying relationship with the top adhesive layer when the label plies are adhered relative to each other to permit selective exposure of the top adhesive layer for adhesion of the top label ply. The top face of the bottom label ply includes a bottom adhesive region, with a bottom adhesive layer being applied along the bottom adhesive region and the top label ply being in overlying relationship with the bottom adhesive layer when the label plies are adhered relative to each other to permit selective exposure of the bottom adhesive layer for adhesion of the bottom ply.

A second aspect of the present invention concerns a stacked label system operable to be adhesively applied to a substrate to carry outer indicia and inner indicia. The label system broadly includes an underlying label and an overlying label. The underlying label is operable to be adhered relative to the substrate. The overlying label is operable to be adhered so as to overlie the underlying label. At least one of the overlying and underlying labels comprises a multiple-ply label that includes unfolded top and bottom label plies, with each ply including top and bottom faces and a face outer edge, with the bottom face of the top label ply and the top face of the bottom label ply being opposed when the label plies are adhered relative to each other. The top label ply has the outer indicia printed thereon. The bottom label ply includes a line of separation located inboard of the face outer edge to present a removable central portion, with the central portion of the bottom label ply having the inner indicia printed thereon. The bottom label ply further includes a removable border portion defined between the face outer edge and the line of separation. The bottom face of the top label ply includes a top adhesive region, with a top adhesive layer being applied along the top adhesive region and a top overlying release coating being in overlying relationship with the top adhesive layer when the label plies are adhered relative to each other to permit selective exposure of the top adhesive layer for adhesion of the top label ply.

A third aspect of the present invention concerns a label operable to be adhesively applied to a substrate to carry publicly displayed indicia on one side and hidden indicia on a second, opposite side. The label broadly includes unfolded top and bottom label plies, an intermediate label ply, a first adhesive layer, and a second adhesive layer. The intermediate liner ply is interleaved between the label plies, with each ply including top and bottom faces and a face outer edge. The first adhesive layer is applied between the bottom face of the top label ply and the top face of the liner ply, with the top label ply having the publicly displayed indicia printed thereon. The second adhesive layer is applied between the top face of the bottom label ply and the bottom face of the liner ply. The top label ply includes a line of weakness defined therein and located inboard of the face outer edge to present a separable central portion, with the top label ply further including an outer separable border portion defined between the face outer edge and the line of weakness. The bottom label ply and the liner ply each include a line of separation located inboard of the face outer edge to present a removable central portion, with the central portion of the bottom label ply having the hidden indicia printed thereon. The bottom label ply and the liner ply each further include a removable border portion defined between the face outer edge and the line of separation. The removable border portions are removable from the top label ply to permit adhesion of the label along the separable border portion to the substrate to cover the hidden indicia. The central portions of the label and liner plies are removable from the separable border portion to expose the hidden indicia.

A fourth aspect of the present invention concerns a method of labeling a package that is to contain contents to be delivered to a recipient. The package labeling method broadly includes the steps of printing recipient address indicia on a top surface of a pressure sensitive label; printing return label indicia on an opposite bottom surface of the pressure sensitive label, with the steps of printing the recipient address indicia and printing the return label indicia further including providing the pressure sensitive label with the address and return label indicia on the respective, oppositely facing surfaces of the label prior to being affixed to the package; and affixing the pressure sensitive label to the package so that the top surface is oriented outwardly to reveal the address indicia and to thereby facilitate delivery of the package to the recipient and so that the bottom surface is oriented toward the package to conceal the return address indicia, with the steps of printing the recipient address indicia and printing the return label indicia being performed simultaneously such that the opposite surfaces are printed in one pass through a duplex thermal printer.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 16:
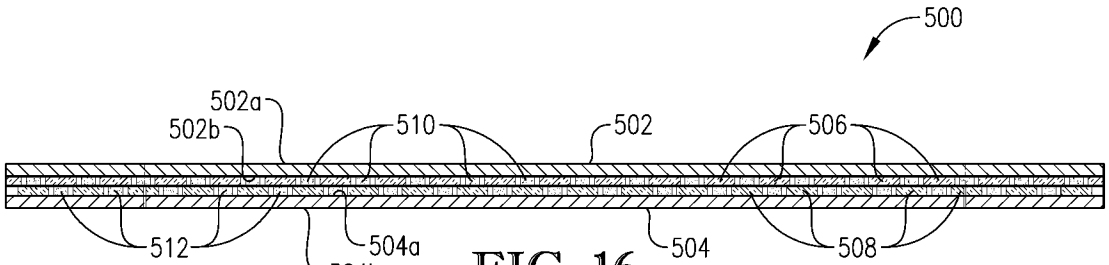
Figure 14:
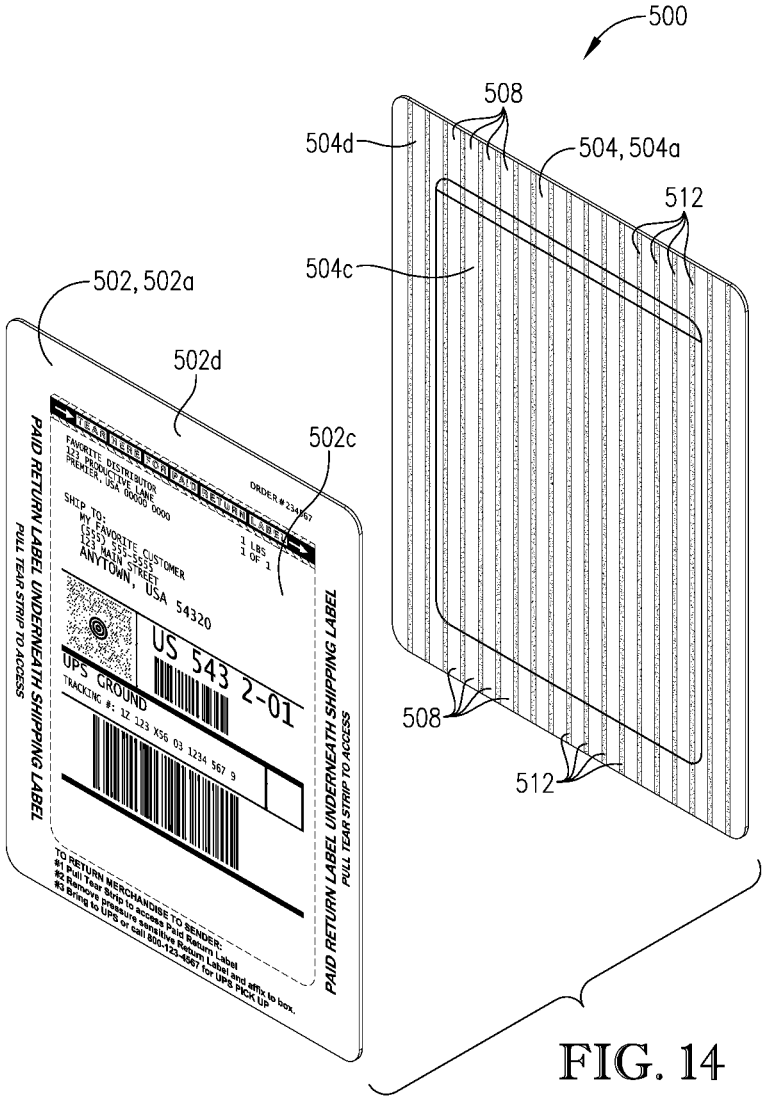
Figure 15:
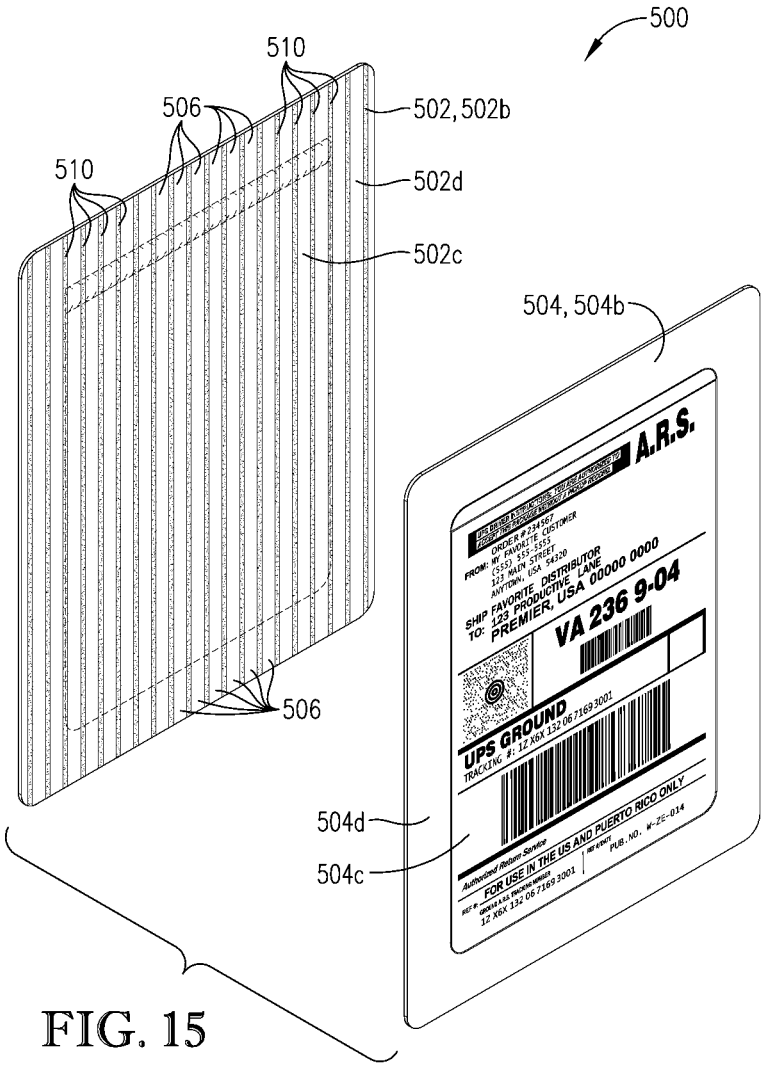
Figure 17:
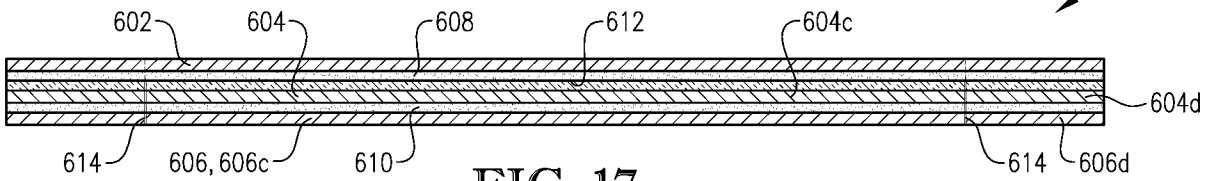
Figure 18:
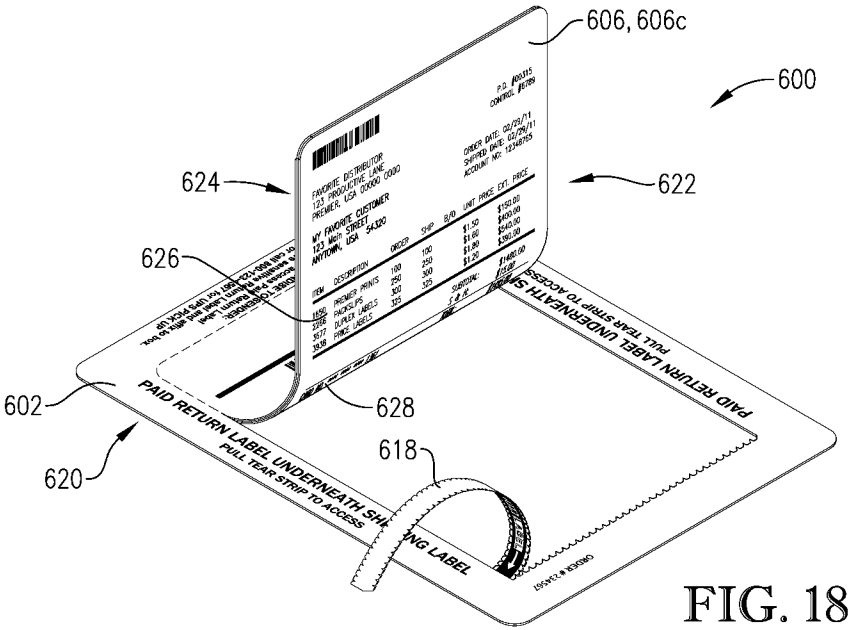
Figure 19:
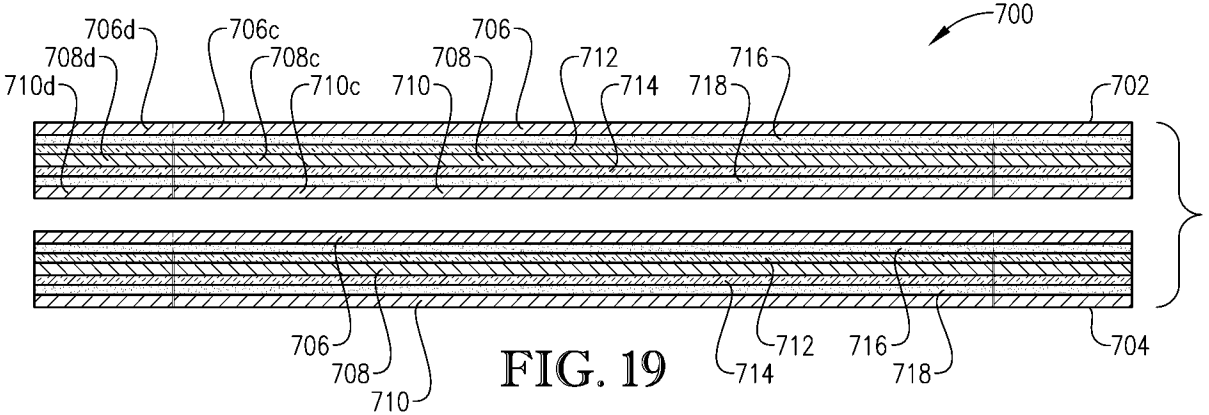
Figure 20:
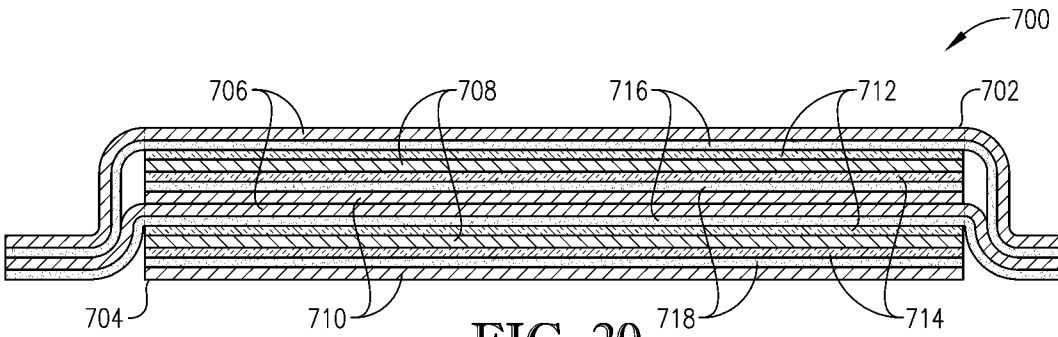
Figure 21:
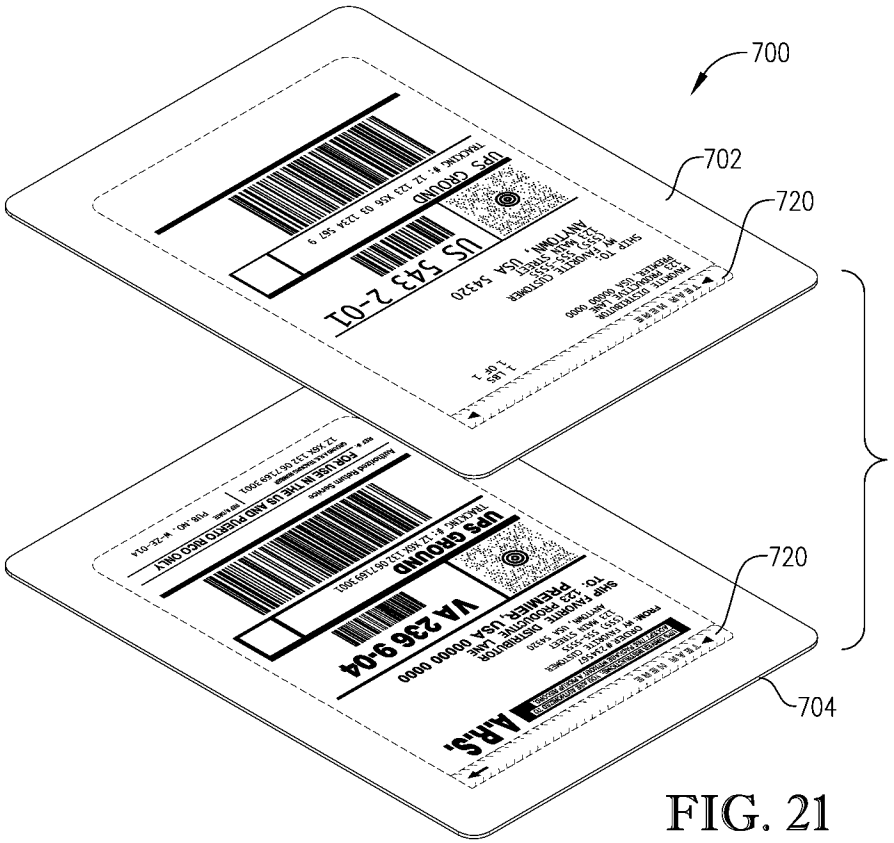
Figure 22:
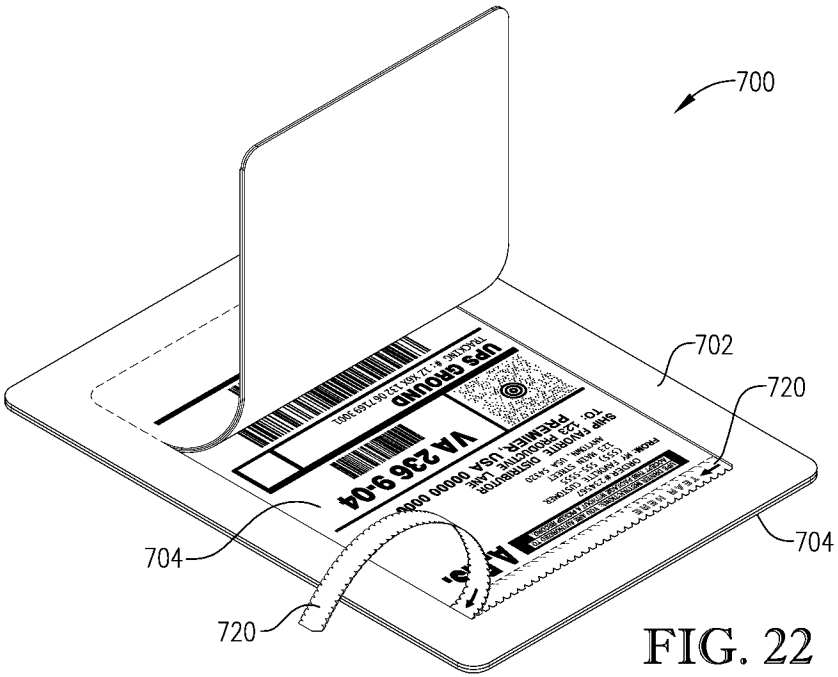
Figure 23:
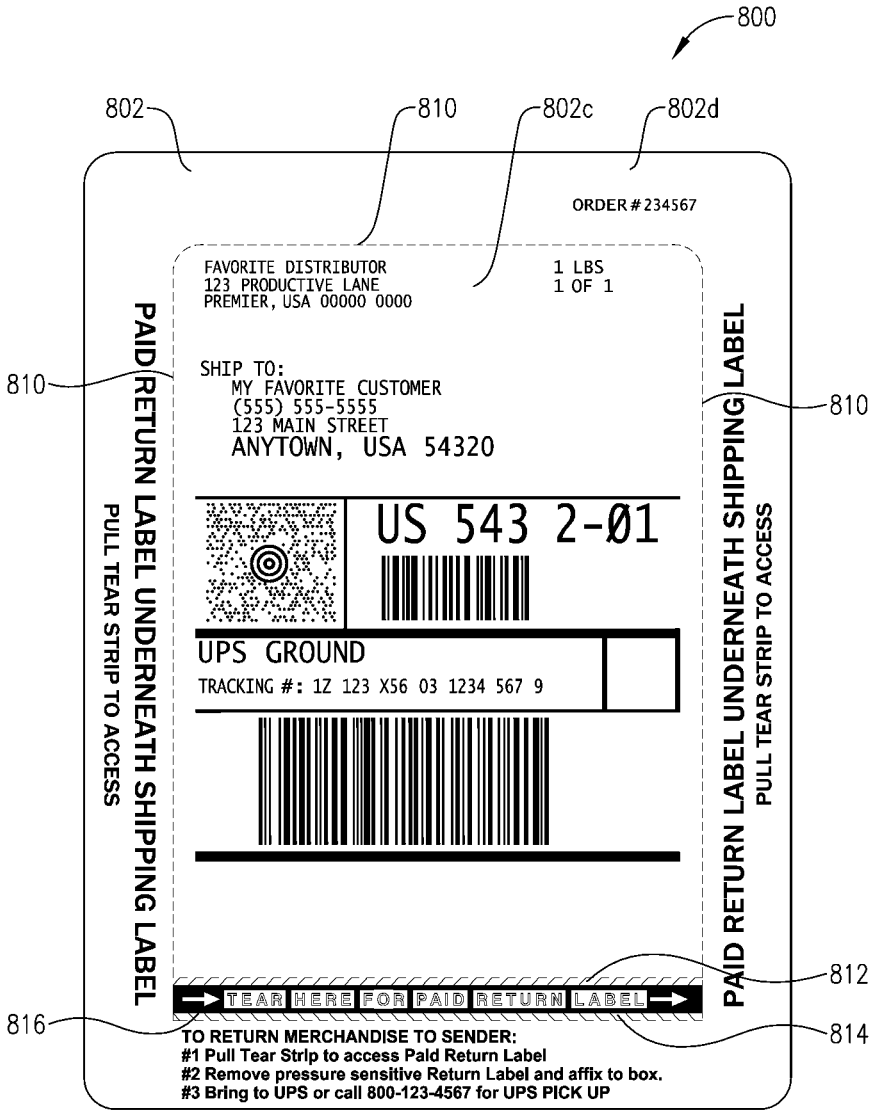
Figure 24:
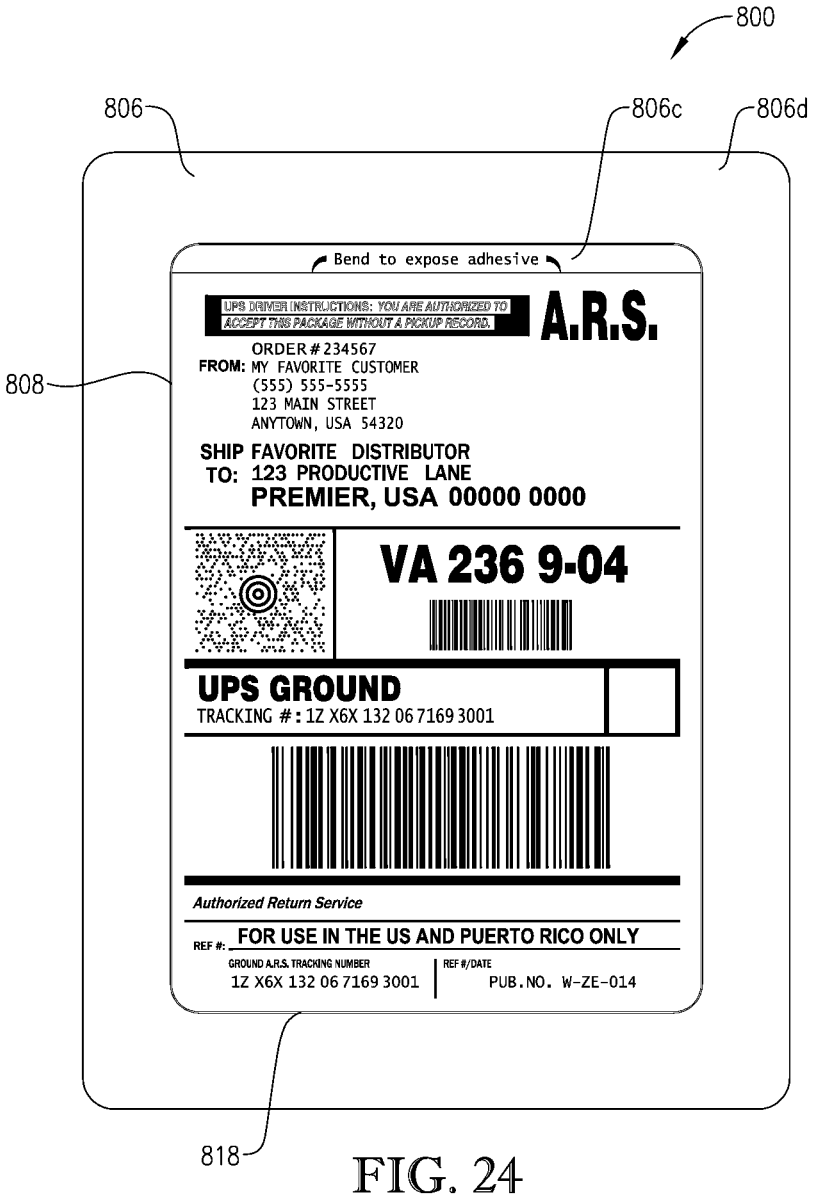
Figure 25:
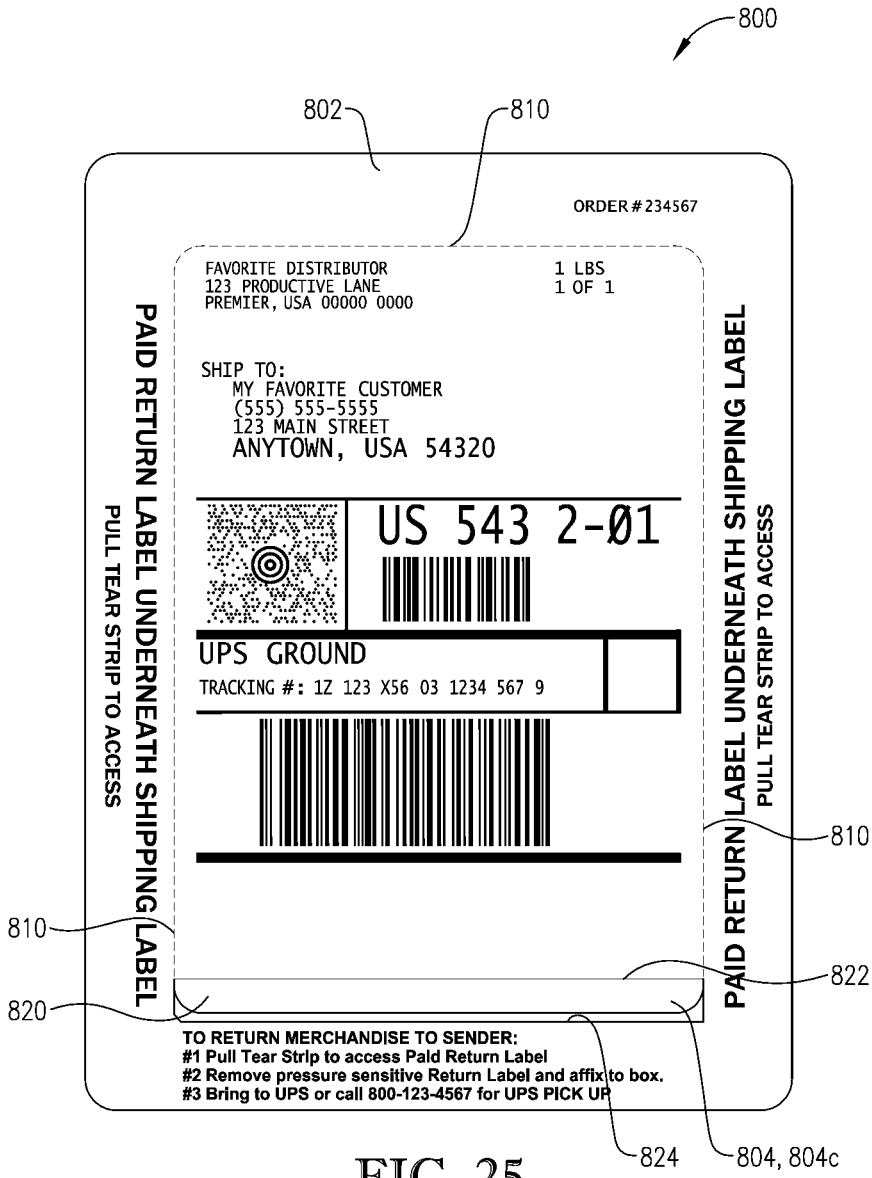

FIG. 14 is an exploded top perspective of a multiple-ply label constructed in accordance with a fifth preferred embodiment of the present invention, showing top and bottom plies of the label and the top face of the bottom ply receiving a bottom release coating and a bottom adhesive layer, with the bottom release coating and adhesive layer being applied in the form of alternating strips of release and adhesive;

FIG. 15 is an exploded bottom perspective of the multiple-ply label shown in FIG. 14, showing the bottom face of the top ply receiving a top release coating and a top adhesive layer, with the top release coating and adhesive layer being applied in the form of alternating strips of release and adhesive;

FIG. 16 is a cross section of the multiple-ply label shown in FIGS. 14 and 15, showing the plies removably adhered to one another by the adhesive layers;

FIG. 17 is a cross section of a multiple-ply label constructed in accordance with a sixth preferred embodiment of the present invention, showing top, middle, and bottom plies of the label, with a release coating applied to a top face of the middle ply, a top adhesive layer applied to the bottom face of the top ply to removably adhere the top and middle plies to one another, and a bottom adhesive layer applied to the top face of the bottom ply to permanently adhere the middle and bottom plies to one another;

FIG. 18 is a perspective of the multiple-ply label shown in FIG. 17, showing a tear strip of the top ply being separated so that central portions of the plies can be separated from the border portion of a top ply to thereby expose the bottom ply;

FIG. 19 is a cross section of a multiple-ply label assembly constructed in accordance with a seventh preferred embodiment of the present invention, showing similar overlying and underlying multiple-ply labels that each include top, middle and bottom plies, release coatings applied to the top and bottom faces of the middle ply, and top and bottom adhesive layers applied to the top and bottom plies to adhere the top and bottom plies to the middle ply, with the labels being detached from each other;

FIG. 20 is a cross section of the multiple-ply label assembly shown in FIG. 19, showing the overlying label adhered to the underlying label, with each label having border portions of the middle and bottom plies removed so that the label can be adhered along the border portion of the top ply;

FIG. 21 is an upper perspective of the multiple-ply label assembly shown in FIGS. 19 and 20, showing the labels detached from one another;

FIG. 22 is an upper perspective of the multiple-ply label assembly shown in FIGS. 19-21 showing the overlying label adhered to the underlying label, with a tear strip and central portions of the overlying label being separated to expose the underlying label;

FIG. 23 is a top view of a multiple-ply label constructed in accordance with an eighth preferred embodiment of the present invention, showing a top ply of the label including central and border portions defined by perforations, with top indicia being printed along the top face of the top ply;

FIG. 24 is a bottom view of the multiple-ply label shown in FIG. 23, showing a bottom ply of the label, with the bottom ply including central and border portions defined by a die cut line, and with bottom indicia being printed along the bottom face of the central portion; and FIG. 25 is a top view of the multiple-ply label as shown in FIG. 23, but with a tear strip of the top ply being removed to show a middle ply of the label, with an exposed end margin of the middle and bottom ply central portions projecting outwardly from an adjacent end margin of the top ply central portion.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
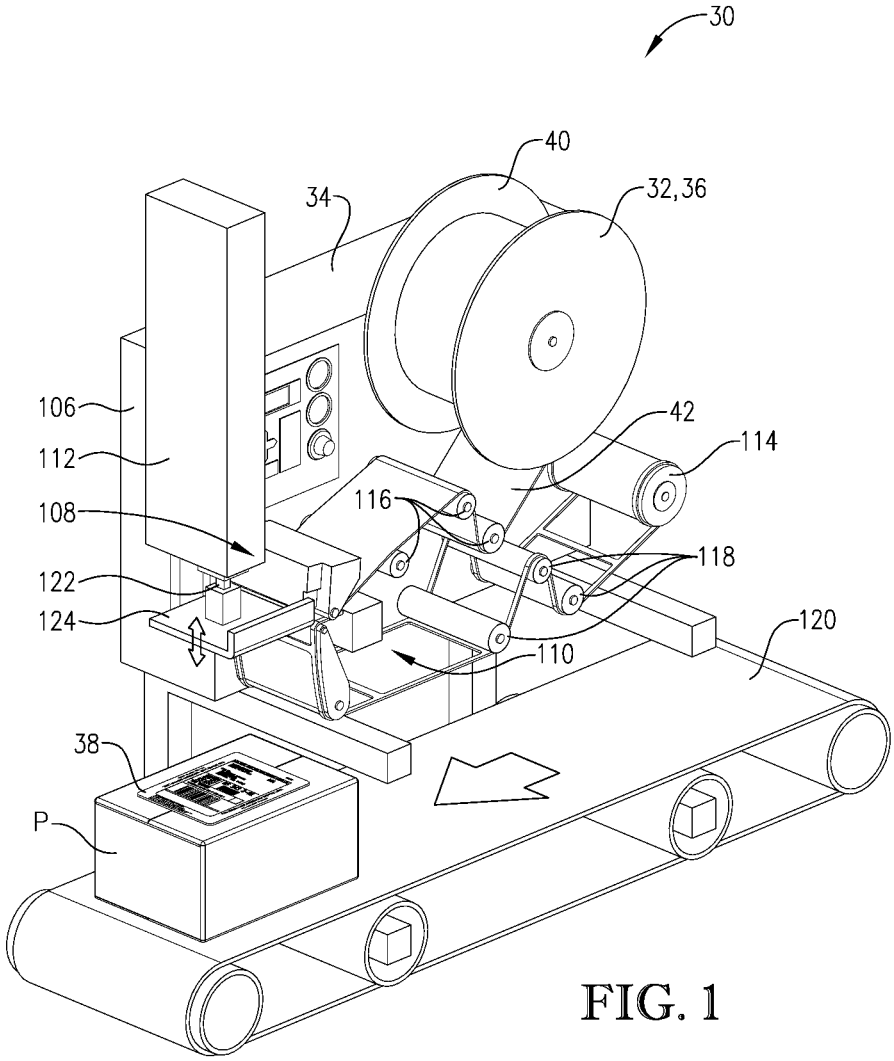
FIG. 1 is a perspective of a multiple-ply label system constructed in accordance with a first preferred embodiment of the present invention, with the label system including an automated print and apply station and a label supply including a plurality of multiple-ply labels attached end-to-end in a label web and wound onto a roll.
Figure 2:
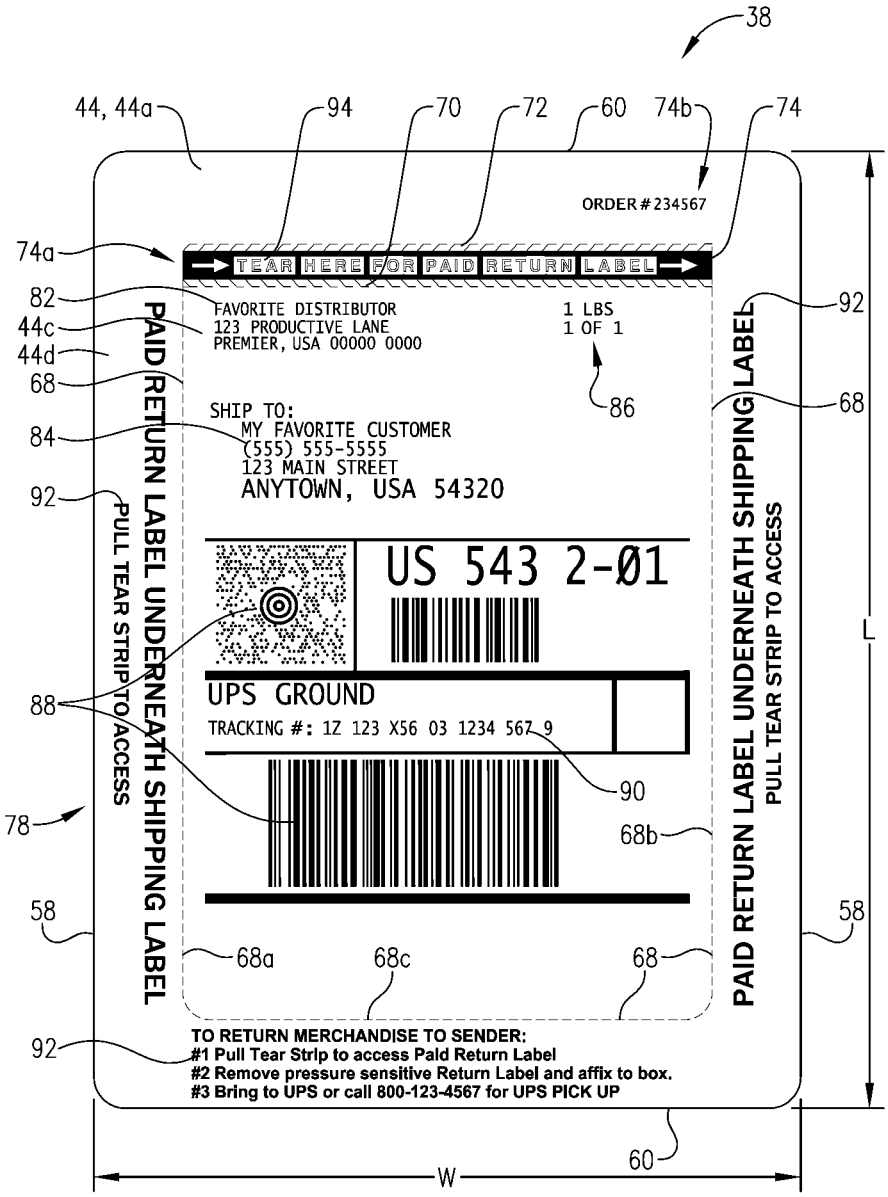
FIG. 2 is a top view of the multiple-ply label shown in FIG. 1, showing a top ply of the label, with the top ply including central and border portions defined by perforations, and with top indicia being printed along the top face of the top ply.
Figure 3:
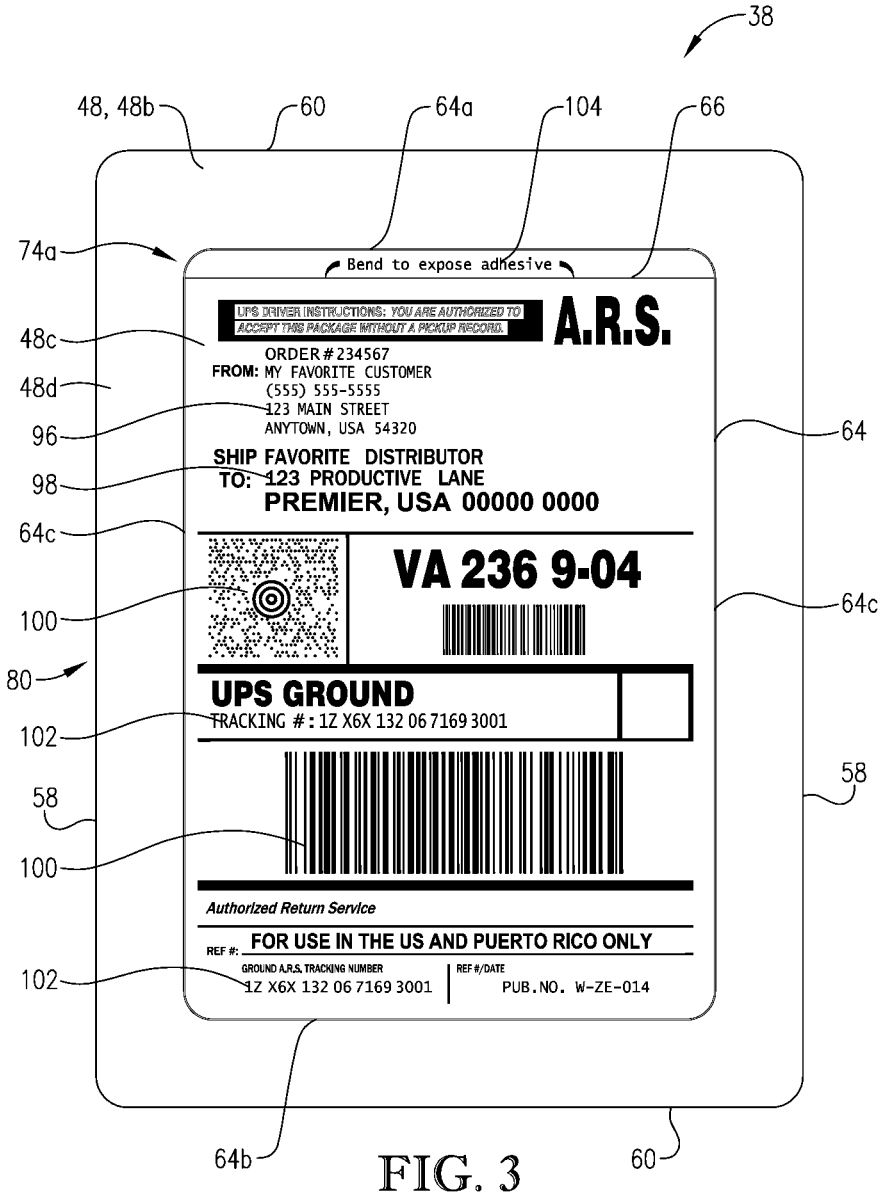
FIG. 3 is a bottom view of the multiple-ply label shown in FIG. 2, showing a bottom ply of the label, with the bottom ply including central and border portions defined by a die cut line, and with bottom indicia being printed along the bottom face of the central portion.

Turning initially to FIGS. 1-3, a label system 30 is constructed in accordance with a first preferred embodiment of the present invention. The illustrated label system 30 is preferably operable to provide automated duplex printing of multiple-ply labels and automated application of printed labels onto corresponding packages. However, as will be discussed in greater detail, the label system 30 includes labels that can be printed using various printing techniques without departing from the scope of the present invention. Furthermore, it is within the ambit of the present invention where the printed labels are applied using other automated techniques or through manual application. The label system 30 broadly includes a label supply 32 and a print and apply station 34.

Turning to FIGS. 1-4, the label supply 32 is preferably in the form of a continuous roll 36, which provides a plurality of unprinted labels for printing and application onto a substrate. The label roll 36 preferably includes a plurality of multiple-ply labels 38 attached end-to-end and a spool 40. As will be discussed, the illustrated label 38 serves as a combination shipping and return label, although the label 38 could present alternative indicia for other suitable uses of the label 38 without departing from the scope of the present invention.

In the illustrated embodiment, the label roll 36 preferably includes a continuous substrate web 42 (i.e., a label substrate) having a top ply 44, middle ply 46, and bottom ply 48, with adhesive and release layers therebetween, as will be discussed (see FIG. 4). Preferably, the plies each include continuous paper stock, but the plies could include other material without departing from the scope of the present invention. Furthermore, for some aspects of the present invention, the web 42 could have an alternative number of plies, as will be shown in subsequent embodiments. The top and bottom plies 44,48 each preferably comprise a thermal paper substrate suitable to receive direct-thermal printing thereon. However, the principles of the present invention are equally applicable where the top and bottom plies 44,48 comprise paper that is suitable to be printed by other printing methods, such as thermal transfer printing, laser printing, ink jet printing, or a combination of these methods. The middle ply 46 preferably comprises a paper substrate that is used principally as a liner and generally does not receive printed indicia thereon. However, it is within the scope of the present invention where the middle ply 46 is configured so that indicia can printed on the top and/or bottom face of the middle ply 46.

The web 42 presents the end-to-end labels 38 and is preferably wound in a roll onto the spool 40. However, the principles of the present invention are applicable where the labels 38 are provided in an alternative configuration for printing and application. For instance, the labels 38 could be attached end-to-end in a fan-fold configuration where adjacent labels 38 are folded on top of one another.

Figure 4:
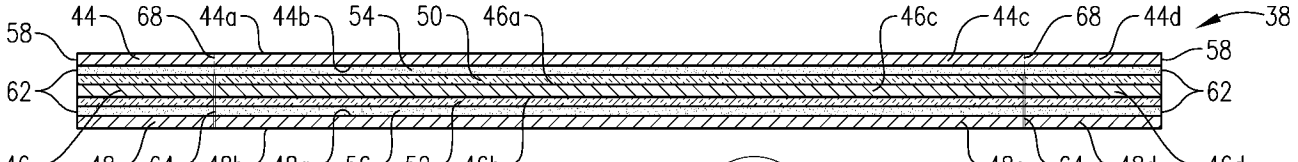
FIG. 4 is a cross section of the multiple-ply label shown in FIGS. 2 and 3, showing the top and bottom plies and a middle ply between the top and bottom plies, with top and bottom release coatings applied to top and bottom faces of the middle ply, and with top and bottom adhesive layers applied to the top and bottom plies to adhere the top and bottom plies to the middle ply.

Turning to FIGS. 2-8, the multiple-ply labels 38 are each configured to receive indicia and broadly include the plies 44,46,48, top and bottom overlying release coatings 50,52, and top and bottom adhesive layers 54,56 (see FIG. 4). The preferred label 38 includes opposite label side edges 58 that define a substantially continuous width W and opposite label end edges 60 that define a length L (see FIGS. 2 and 3). Preferably, the width W is in the range of about one (1) inch to about eight (8) inches and, more preferably, about three (3) inches to about seven (7) inches. The length L is preferably in the range of about one (1) inch to about fourteen (14) inches and, more preferably, about six (6) inches to about ten (10) inches.

Each of the plies 44,46,48 preferably present opposite top faces 44*a*,46*a*,48*a* and bottom faces 44*b*,46*b*,48*b* that each extend to respective face outer edges. The top face 44*a* of the top ply 44 and the bottom face 48*b* of the bottom ply 48 are preferably printable by direct-thermal printing methods. Again, the principles of the present invention are equally applicable where the label 38 is configured to be printed using another printing method, e.g., thermal transfer printing, laser printing, ink jet printing, or a combination of these printing methods.

The release coatings 50,52 permit the plies 44,46,48 to be removably adhered to one another, as will be discussed. The top release coating 50 is preferably applied in a continuous layer on the top face 46*a* of the middle ply 46 so as to cover the entire top face 46*a*. The bottom release coating 52 is preferably applied in a continuous layer on the bottom face 46*b* of the middle ply 46 so as to cover the entire bottom face 46*b*. In this manner, the middle ply 46 provides an intermediate dual-sided release liner ply. It is also within the ambit of the present invention where one or both of the release coatings 50,52 are patterned. For instance, a release coating could be print-applied along only the border portion 44*d* of the top ply 44 so that the central portions of the top and middle plies are permanently adhered to one another. As will be shown in subsequent embodiments, both top and bottom plies could have patterned release coating.

Also, for some aspects of the present invention the label 38 could be devoid of one or both release coatings 50,52. For instance, the adhesive layers 54,56 could be comprised of a temporary adhesive that permits removal of the plies 44,46,48 from one another without the use of release coating. Each release coating 50,52 preferably comprises a silicone coating, although the coatings could include another material to provide a release mechanism.

The illustrated adhesive layers 54,56 serve to removably adhere the plies 44,46,48 to one another. The top adhesive layer 54 is preferably applied in a continuous layer on the bottom face 44*b* of the top ply 44 so as to cover the entire bottom face 44*b*. The bottom adhesive layer 56 is preferably applied in a continuous layer on the top face 48*a* of the bottom ply 48 so as to cover the entire top face 48*a*. Thus, the top adhesive layer 54 preferably adheres the top and middle plies 44,46 to each other and the bottom adhesive layer 56 preferably adheres the middle and bottom plies 46,48 to each other. The principles of the present invention are equally applicable where the adhesive layers 54,56 are patterned. As will be shown in subsequent embodiments, the adhesive layers 54,56 could be applied along only a portion of respective ply faces.

Figure 5:
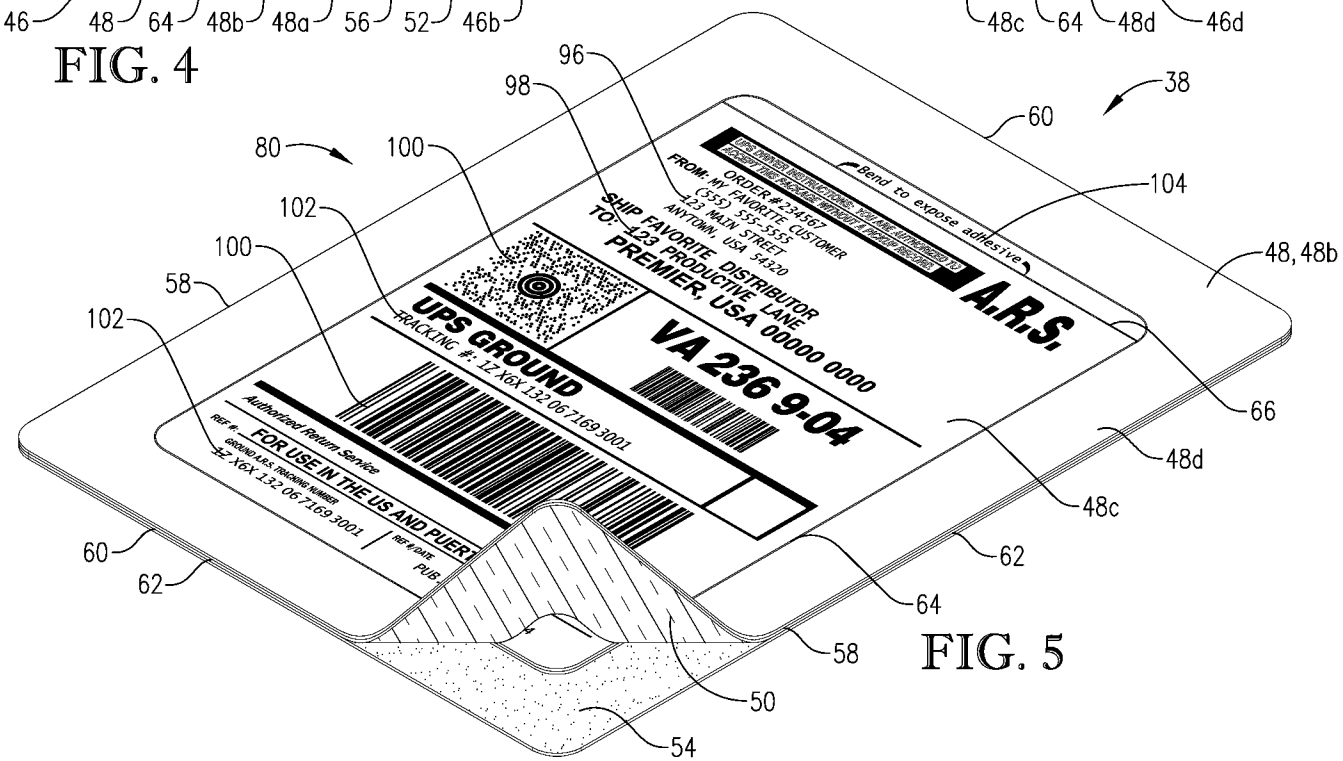
FIG. 5 is a lower perspective of the multiple-ply label shown in FIGS. 2-4, showing the border portions of the middle and bottom plies partly separated from the top ply.

Preferably, the illustrated adhesive layers 54,56 each extend outwardly to an outer adhesive margin 62 that preferably extends along the edges 58,60 (see FIGS. 4 and 5). With respect to the top adhesive layer 54, this construction reduces the risk of inadvertent label removal (e.g., during shipping). However, the principles of the present invention are applicable where one or more of the plies 44,46,48 extend outwardly from the adjacent adhesive layer (e.g., to provide an outer adhesive-free part of the label 38).

The plies 44,46,48 each preferably include a central portion 44*c*,46*c*,48*c* and a border portion 44*d*,46*d*,48*d* (see FIG. 4). Each of the illustrated border portions 44*d*,46*d*,48*d* preferably extends endlessly about the respective central portions 44*c*,46*c*,48*c*, although the border portions could have an alternative configuration (e.g., where the border portion 44*d* is separated into two section by a tear strip that extends from one label side edge 58 to the opposite label side edge 58). The top ply 44 preferably has adhesive layer 54 applied on both portions 44*c*,44*d*, and the bottom ply 48 preferably has adhesive layer 56 applied along both portions 48*c*,48*d*. However, as will be shown in a subsequent embodiment, the adhesive layers 54,56 could be applied only along one of the border and central portions for each of the top and bottom plies 44,48. The middle ply 46 preferably has release coating applied along both central and endless border portions 46*c,d* on each face 46*a,b* of the middle ply 46. However, it is within the scope of the present invention where release coating is applied to a face of the middle ply 46 only along one of the portions 46*c,d*. For instance, release coating could be applied only along border portion 46*d* on the top face so that the central portion 46*c* on the top face is devoid of release coating and the central portions 44*c*,46*c* are permanently adhered.

The illustrated adhesive layers 54,56 each preferably comprise a permanent adhesive. As used herein, the term "permanent adhesive" refers to an adhesive that is operable to adhere a label ply to the package P, to another label ply, or to another substrate, with removal of at least part of the label ply from adhesion to the substrate resulting in physical damage to the label ply and/or the substrate, and with the damage being visibly evident to the naked eye. In this manner, the use of permanent adhesive serves to make the applied label 38 tamper-evident. Any of various suitable permanent adhesives, such as pressure sensitive adhesive, could be employed to adhere the label plies to one another. However, according to some aspects of the present invention, the adhesive layers 54,56 could alternatively comprise a temporary adhesive, i.e., adhesive that permits label ply removal without visibly damaging the label ply or substrate and repositioning of the label ply in adhesive engagement with the same or another substrate. For some aspects of the present invention, another mechanism could be used to cause the label 38 to be tamper-evident.

The middle and bottom plies 46,48 each include an endless line of separation 64 with end portions 64*a,b* and side portions 64*c* that extend along corresponding sides of the plies (see FIGS. 3 and 4). The bottom ply 48 also preferably includes an end line of separation 66 positioned adjacent one end portion 64*a* of the bottom ply 48 (see FIG. 3). The plies 46,48 could have other lines of separation. For instance, the plies 46,48 could each have a die cut (or perforation line) adjacent end portion 64*a* so that the plies each have a removable strip that is in registration with and removable with the tear strip of the top ply 44. In such an alternative configuration, the additional die cut lines of plies 46,48 could extend in registration with end perforation 70, with the end line of separation 66 being spaced longitudinally between the additional die line of bottom ply 48 and the end portion 64*b*. The principles of the present invention are also applicable where no end line of separation 66 is included.

The lines of separation 64,66 preferably comprise die cut lines, but it is also within the scope of the present invention where the lines of separation 64,66 include a perforation line. Preferably, the endless lines of separation 64 extend between and thereby define central and border portions 46*c,d* of the middle ply and portions 48*c,d* of the bottom ply, with the central portions 46*c*,48*c* being removable from the respective border portions 46*d*,48*d*. When the middle and bottom plies 46,48 are adhered in registration with one another, the die cut lines are preferably aligned so that the central portions 46*c*, 48*c* are substantially the same size and are superposed with each other. Furthermore, the border portions 46*d*,48*d* are preferably substantially the same size and are superposed with each other when the middle and bottom plies 46,48 are adhered in registration with each other. However, for some aspects of the present invention, the die cut lines of plies 46,48 could be offset from one another. Also, the central portions or border portions of plies 46,48 could have different shapes and/or sizes.

The top ply 44 further includes side perforation 68 with portions 68*a,b,c* that extends along three corresponding sides of the top ply 44 and end perforations 70,72 (see FIG. 2). Preferably, the perforations 68,70,72 extend between and thereby define central and border portions 44*c,d* of the top ply 44, with the central portion 44*c* being entirely removable from the border portion 44*d*. However, for some aspects of the present invention, the central portion 44*c* may not be defined by perforations (e.g., where the label 38 is devoid of perforations).

Figure 6:
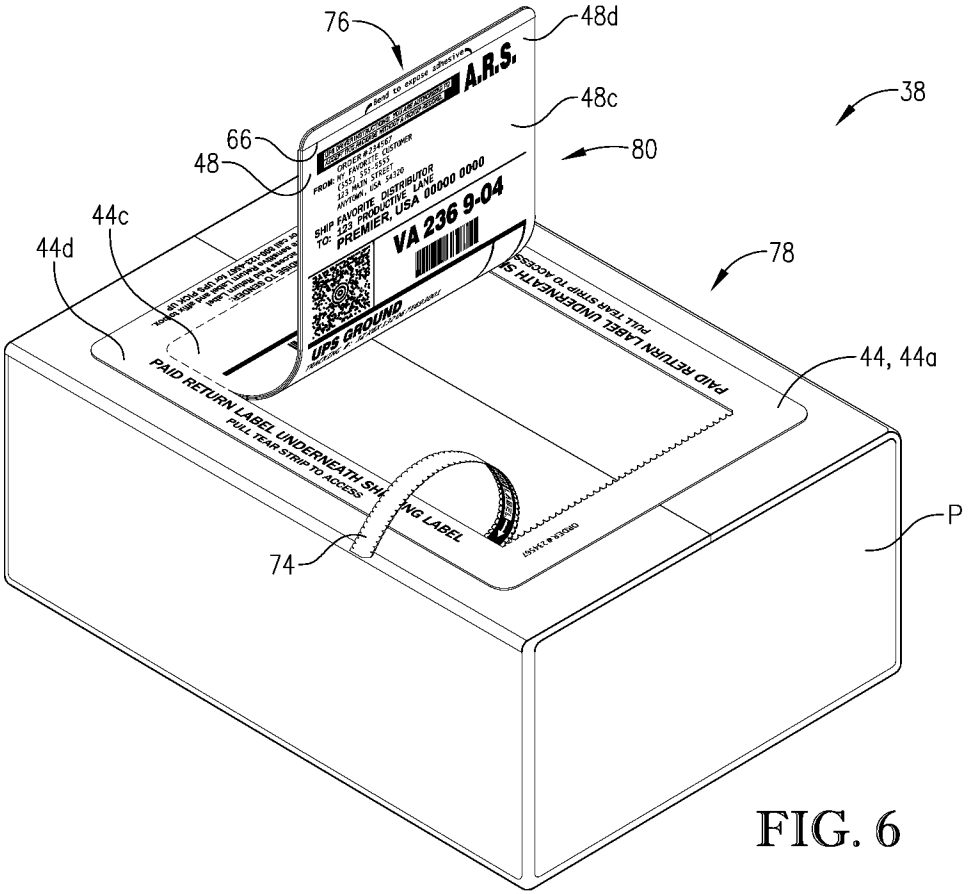
FIG. 6 is an upper perspective of the multiple-ply label shown in FIGS. 2-5, showing the border portions of the middle and bottom plies removed so that the label is adhered to a package, with a tear strip of the label being separated from the border portion of the top ply and with the central portions of the label plies being partly separated from the border portion of the top ply.
Figure 7:
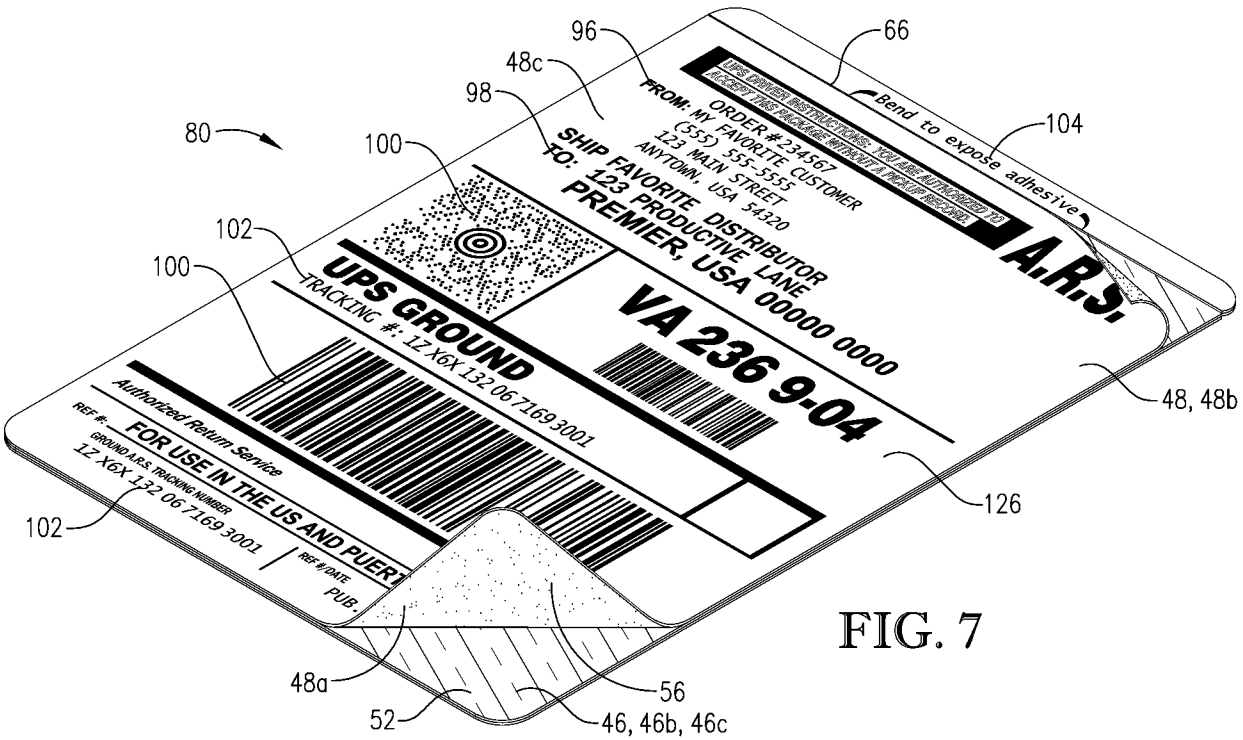
FIG. 7 is a fragmentary lower perspective of the multiple-ply label shown in FIGS. 2-6, showing the central portions of the label plies, with the bottom label ply being partly separated from the other label plies.
Figure 8:
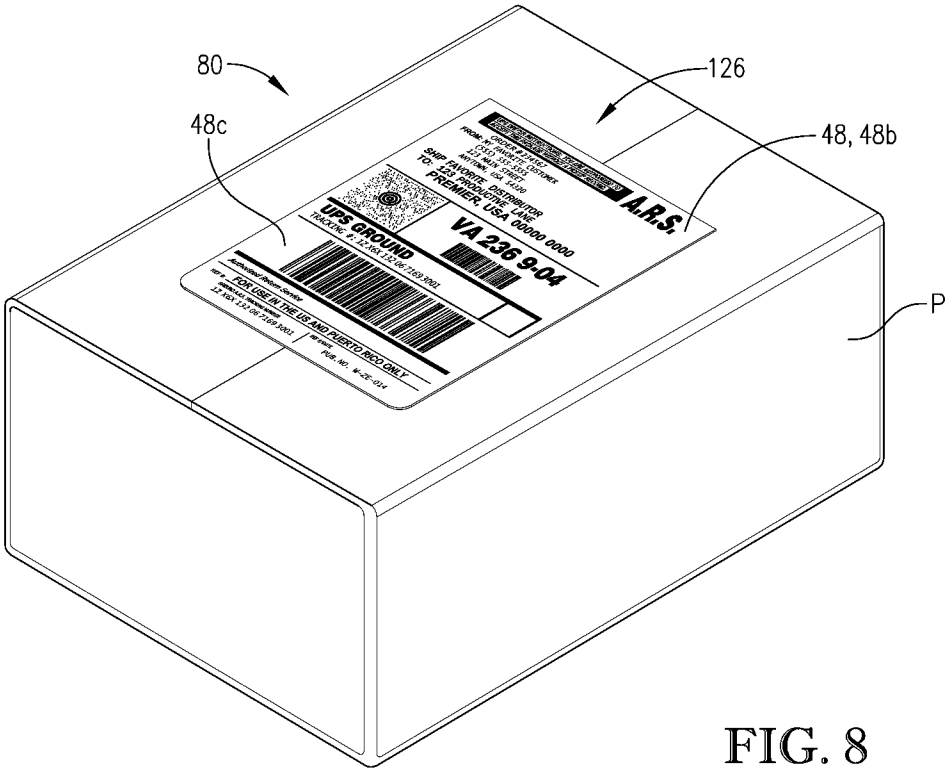
FIG. 8 is an upper perspective of the central portion of the bottom label ply shown in FIG. 7, showing the central portion of the bottom label ply being adhered to a package to provide a return label.

Turning to FIGS. 2 and 6, perforations 70,72 extend along the central portion between ends of side perforation 68, with perforation 70 being inwardly spaced from and adjacent to perforation 72. Preferably, perforations 68,70,72 cooperatively define a tear strip 74 of the central portion 44*c* that connects portions of the top ply 44 to one another. The illustrated tear strip 74 preferably extends from one side portion 68*a* of perforation 68 to another side portion 68*b* (see FIG. 2). Furthermore, the illustrated tear strip 74 is configured to be initially separated at a left tear strip end 74*a* adjacent the side portion 68*a* so that the left tear strip end 74*a* can be pulled by a user in a direction toward the right tear strip end 74*b* and the side portion 68*b* to further separate the tear strip 74 (see FIG. 2). However, the tear strip 74 could be alternatively configured to provide user access. For example, the tear strip 74 could extend across both the central and border portions 44*c,d* so that both of the tear strip ends 74*a,b* extend to respective label side edges 58. Alternatively, the tear strip 74 could be positioned with one of the tear strip ends 74*a,b* at a respective label side edge 58 and the other of the tear strip ends 74*a,b* extending to a respective side portion 68*a,b* but not across the border portion 44*d*.

Furthermore, the tear strip 74 could be arranged to extend along the length of the label 38. For instance, the tear strip 74 could extend from end perforation 72 to the perforation end portion 68*c*. The tear strip 74 could also extend from one label end edge 60 to the other label end edge 60. Alternatively, the tear strip 74 could extend longitudinally so that one of the tear strip ends 74*a,b* at a respective label end edge 60 and the other one of the tear strip ends 74*a,b* is at a respective one of the perforation 72 and perforation end portion 68*c*. It is also within the scope of the present invention where the top ply 44 does not include tear strip 74.

When the top and middle plies 44,46 are adhered in registration with one another, the die cut lines and perforations 68,72 of the plies are preferably aligned so that the central portions 44*c*,46*c* are substantially the same size and are superposed with each other. Furthermore, the border portions 44*d*,46*d* are preferably substantially the same size and are superposed with each other when the top and middle plies 44,46 are adhered in registration with each other. However, for some aspects of the present invention, the die cut lines and perforations 68,72 of plies 44,46 could be offset from one another. Also, the central portions or border portions of plies 44,46 could have different shapes and/or sizes.

The label 38 preferably includes the tear strip 74 so that the tear strip 74 can be removed to present an unsupported margin 76 of the central portion 44*c* adjacent an end of the top ply 44. In the illustrated embodiment, the tear strip 74 is removed from the middle and bottom plies 46,48 during separation. However, as discussed above, it is also within the scope of the present invention where plies 46,48 have die cut lines (or perforation lines) adjacent end portions 64*a* so that the plies have a strip that is removable with the tear strip 74 of the top ply 44. The unsupported margin 76 permits a user to grab the central portions 44*c*,46*c*,48*c* of each ply and remove the central portions 44*c*,46*c*,48*c* from the label 38 by pulling the margin 76 in a direction toward the opposite end of the label 38. However, it is within the ambit of the present invention where the label 38 has an alternative feature to provide user access to central portions. For instance, the label 38 could present an opening between the central and border portions 44*c*,44*d* to provide user access to the central portions and, particularly, to the bottom ply. Again, the illustrated tear strip 74 is preferably positioned at one end of the central portion 44*c*, but could be alternatively positioned (e.g., along one side of the central portion 44*c*) without departing from the scope of the present invention.

Turning again to FIGS. 2-8, the printed label 38 includes top and bottom indicia 78,80 printed respectively on the top face 44*a* of the top ply 44 and the bottom face 48*b* of the bottom ply 48. In this manner, the top face 44*a* and bottom face 48*b* preferably serve as top and bottom faces of the label 38. As will be shown, the indicia 78,80 may include variable indicia (i.e., indicia that can vary with each label and associated package P) and non-variable indicia (i.e., indicia that generally does not change from label to label or from order to order). Furthermore, some of the indicia may be preprinted (e.g., before the web 42 is wound onto spool 40). The top indicia 78 presented on top face 44*a* includes sender address indicia 82, recipient address indicia 84, package size and package number indicia 86, bar code indicia 88 operable to provide a unique identifier associated with the package P that can be electronically scanned, package tracking indicia 90 operable to identify the carrier and a unique carrier tracking number associated with the package P, margin indicia 92, and tear strip indicia 94 (see FIG. 2). The illustrated top indicia 78 is printed across the central and border portions 44*c,d*, but the principles of the present invention are applicable where the indicia 78 is alternatively printed on the portions 44*c,d* or is printed on only one of the portions 44*c,d*. As will be discussed, the top indicia 78 is generally exposed and visible when the label 38 is applied to the package P.

Turning to FIGS. 3-7, the bottom indicia 80 presented on the bottom face 48*b* includes return sender address indicia 96, return recipient address indicia 98, bar code indicia 100 operable to provide a unique identifier associated with the package P that can be electronically scanned, package tracking indicia 102 operable to identify the carrier and a unique carrier tracking number associated with the package P, and instruction indicia 104 associated with end line of separation 66. The illustrated bottom indicia 80 is preferably printed on the central portion 48*c* and is generally hidden from view when the label 38 is applied to the package P (see FIG. 1). However, the principles of the present invention are applicable where at least some indicia printed on the bottom face 48*b* is printed on the border portion 48*d* or on both of the central and border portions 48*c,d*.

The top and bottom indicia 78,80 are preferably printed by direct-thermal printing, but each of the indicia 78,80 could be printed by other printing methods, such as thermal transfer, laser, ink jet printing, or a combination of printing methods. It is also within the scope of the present invention where the top indicia 78 is printed by one printing method and the bottom indicia 80 is printed by a different printing method. For instance, one of the indicia 78,80 could be printed by direct-thermal printing and the other one of the indicia 78,80 could be printed by thermal transfer printing. Also, one of the indicia 78,80 could be printed by ink jet printing and the other one of the indicia 78,80 could be printed by direct-thermal printing.

The indicia 92,94,104 generally comprise non-variable indicia. Indicia 80,82,84,86,88,90,96,98,100,102 generally includes variable indicia. Thus, both faces of the label 38 include variable indicia, and variable indicia on both faces of the label 38 can be associated with a particular customer order contained within package P. As will be discussed further, in printing indicia on both label faces, the indicia 78 on the top face 44*a* can be matched with the indicia 80 on the bottom face 48*b* to provide all of the indicia associated with the corresponding order. This facilitates proper shipment of the correct items to the correct recipient.

The illustrated label 38 is configured so that the bottom indicia 80 is located on the bottom face 48*b* along the central portion 48*c* and is thereby hidden when the label 38 is applied to the package P. Thus, the label 38 must be at least partly removed from the package P to access the bottom indicia 80. Due to this tamper-evident label construction, the label 38, package P, or both are visibly damaged when the label 38 is at least partly removed from the package P.

The top and bottom indicia 78,80 comprise the only information associated with the package P that is carried by the illustrated label for visual and electronic identification (by the sender, distributor, or recipient) of the package P and the associated customer order. But it is also within the ambit of the present invention where the label 38 includes other package or order identification features, e.g., other types of machine-readable features. For instance, the label 38 could include an RFID tag attached to the plies that can carry information in electronic form and can be electronically programmed and read.

Turning again to FIG. 1, the labels 38 are attached end-to-end to form the continuous web 42, and the web 42 is wound to form the roll 36. In particular, the labels 38 are arranged so that the top face 44*a* and bottom face 48*b* each extend continuously along the length of the web 42. Thus, the web 42 is mounted to the spool 40 with the bottom face 48*b* engaging the spool 40. There is preferably no perforation or other line of separation between adjacent labels 38. However, for some aspects of the present invention, the labels 38 could be separated by a perforation line (e.g., when the labels 38 are intended to be manually removed from a printer and applied to package P).

As the web 42 is wound to form the roll 36, the bottom face of each label 38 overlies the top face of the underlying label 38 on the roll 36. The end-most label 38, i.e., the label 38 at an exposed end of the web 42, can be removed from overlaid engagement with the label 38 therebelow and can be separated from the web 42 between itself and the adjacent label 38. As mentioned above, the labels 38 could be organized for use in an alternative configuration. For instance, the labels 38 could be attached end-to-end in a fan-fold configuration where adjacent labels 38 are folded on top of one another.

The station 34 is configured to print and apply a label 38 to package P. The station 34 includes a housing 106, upper and lower print heads 108,110, a label applicator 112, a take-up roll 114, incoming rolls 116, outgoing rolls 118, and a powered conveyor 120. The web 42 is fed from the roll 36, through rolls 116, through print heads 108,110, through rolls 118, and to take-up roll 120. The station 34 is configured to print the label 38 in a single printing pass, as will be discussed. The print heads 108,110 are configured to print indicia 78,80 on corresponding top and bottom faces 44*a*,48*b*.

The conveyor 120 preferably includes multiple rollers and an endless belt entrained around the rollers, with one of the rollers being powered. However, it is also within the scope of the present invention where the conveyor 120 has an alternative configuration. For instance, the conveyor 120 could be unpowered, e.g., where the conveyor includes a series of unpowered rolls spaced along the length of the conveyor.

As the web 42 passes through the print heads 108,110, the top and bottom faces 44*a*,48*b* are preferably printed simultaneously as the label 38 is fed continuously through the print heads 108,110 at a constant speed. However, the principles of the present invention are applicable where the faces 44*a*,48*b* are printed sequentially during the single printing pass. The single printing pass could involve some back-and-forth movement of the label 38 as the label 38 is being printed.

The illustrated print heads 108,110 are preferably direct-thermal print heads. However, the principles of the present invention are applicable where the station 34 includes another type of print head, such as a thermal transfer head, a laser head, an ink jet head, or a combination of print head types. For instance, the station 34 could have one type of print head that serves as the upper print head 108 to print the top face 44*a* and another type of print head spaced below the upper print head 108 and serving as the lower print head 110 to print the bottom face 48*b*. Furthermore, multiple types of print heads could be used to print either the top or bottom faces 44*a*,48*b*. While all of the illustrated indicia on the label 38 is printed by the station 34 using direct-thermal printing, it is also within the scope of the present invention where at least some of the indicia on the label is printed using thermal transfer, laser, ink jet printing, or a combination of these printing methods. Furthermore, some of the indicia 78,80, particularly the non-variable indicia, could be pre-printed on the continuous web 42 (i.e., prior to printing by the station 34).

As discussed above, the label system 30 is operable to print the labels 38 on both faces with variable indicia, such as recipient address indicia and sender address indicia. All of the variable indicia printed on the label 38 is associated with the particular package P, the contents of the package P, and the recipient of the package P. Therefore, the system 20 associates (or matches) all of the variable indicia for each label 38 prior to printing of the label 38. For example, the station 34 preferably includes a computer (not shown) for compiling and associating the information for each label 38. The station 34 also controls the print heads 108,110 so that the associated (or matched) indicia is printed on the same label 38. It is also within the scope of the present invention where only some portions of the variable indicia printed on the label 38 are associated with each other. Also, while the illustrated variable indicia is associated with the corresponding package P, some variable indicia could be associated by another type of association (e.g., the recipient address and purchase order indicia could be associated with the name of a recipient).

The label applicator 112 is configured to apply label 38 to package P when the package P is in a labeling position (see FIG. 1). The applicator 112 includes an applicator arm 122 and an applicator pad 124 attached to the end of the arm 122. Preferably, the label applicator 112 further includes a vacuum source (not shown) that is operably coupled to the pad 124. The vacuum source is operable to produce a vacuum condition adjacent a lower pad surface (not shown) of the pad 124 so that the vacuum pressure (i.e., pressure less than ambient pressure) provided by the vacuum source is sufficient to hold the label 38 against the lower pad surface. Also, the vacuum source is operably coupled to a controller (not shown) of the label applicator 112 so that the controller can operate the vacuum source to selectively apply or remove the vacuum condition. Thus, the label applicator 112 is preferably configured so that one of the labels 38 can be held in engagement with the lower pad surface when the vacuum condition is applied.

The arm 122 is slidably mounted to a housing of the applicator 112 so that the arm 122 can reciprocate relative to the housing. The label applicator 112 also preferably includes a motor (not shown), such as a pneumatic or electric servo motor, drivingly attached to the arm 122 and operable to shift the arm 122 relative to the housing. The controller of the label applicator 112 is operably coupled to the motor so that the controller can operate the motor to selectively move the arm 122 and pad 124 between a retracted position (see FIG. 1) and an extended position (not shown). In the retracted position, the pad 124 is preferably spaced from the package P (e.g., to allow shifting of the package P into or out of the labeling position). In the extended position, the pad 124 is positioned adjacent to or in direct contact with package P, when the package P is in the labeling position, to apply the label 38 to the package P.

The illustrated label applicator 112 is operable to locate the pad 124 in the retracted position to receive and hold a label 38 for subsequent application to the package P. In the retracted position, the vacuum condition is applied so that the endmost label 38 is drawn into engagement with the lower pad surface and held in place. Furthermore, the vacuum condition is preferably maintained as the pad 124 and label 38 are shifted from the retracted position to the extended position.

The label applicator 112 is operable to shift the arm 122 and pad 124 into the extended position to apply the held label 38 to the package P. Preferably, the conveyor 120 continuously moves the package P in the indicated direction as the label 38 is applied to the package P. However, it is also within the scope of the present invention where the conveyor 120 momentarily stops the package P for label application. The label applicator 310 can then return the arm 122 and pad 124 from the extended position to the retracted position so that another label 38 can be applied to another package. The illustrated station 34 preferably includes a TwinPrint Automated Printer Applicator manufactured by FOX IV Technologies, Inc. of Export, Pa., although other types of printers and/or print-and-apply systems could be used. For instance, a hand-apply label printer could be used to print labels that are subsequently manually applied. In using this alternative system, the printer could include a label cutter to sever the endmost label from the label supply. Alternatively, the web 42 could include perforation lines that extend between and separate adjacent labels 38 so that the endmost label can be manually removed from the web 42 without the use of a label cutter. Hand-apply label printers would preferably use the web 42 in a fan-fold configuration, although such printers could also utilize the web 42 in a roll form.

While the system 30 preferably includes the automated print and apply station 34, it is within the scope of the present invention where some steps of the label print and application process are performed manually. Because the station 34 is configured to print variable indicia on both label faces, the station 34 can also apply labels 38 to a plurality of packages P, where each package P has at least some indicia that is different from the other packages P. For instance, the station 34 is operable to print and apply labels 38 to multiple packages P, with each package P having different contents and each label 38 having different indicia associated with the contents (e.g., where the recipient address indicia is different between each package P).

Turning to FIGS. 5-8, the printed label 38 can be adhered to package P by removing the border portions 46*d*,48*d* of middle and bottom plies 46,48. In particular, the top adhesive layer 54 and top release coating 50 permit removal of the border portions 46*d*,48*d*. The illustrated station 34 preferably automatically removes the border portions 46*d*,48*d* of the middle and bottom plies 46,48. However, the principles of the present invention are applicable where the border portions 46*d*,48*d* are removed manually.

The label 38 is preferably adhered in a flat, unfolded condition. It has been found that applying the label 38 in a flat and unfolded condition on package P is preferable, particularly for multiple-ply shipping labels, because the label 38 is resistant to inadvertent damage or removal caused by package handling and distribution. Importantly, the illustrated label 38 effectively resists damage caused by exposure to handling equipment of large-volume parcel shippers.

The central portions 44*c*,46*c*,48*c* of the adhered label 38 are removable from the border portion 44*d* of the top ply 44 by initially separating the tear strip 74 from the border portion 44*d*. In particular, one end of the tear strip 74 is grabbed and drawn by the user toward the other end of the tear strip 74. The tear strip 74 can be either partly or completely removed, and this separation of the tear strip 74 leaves the label 38 in an unsecured configuration where the bottom indicia 80 is no longer securely concealed. Furthermore, the unsupported margin 76 of the central portions 44*c*,46*c*,48*c* is exposed to permit the user to grab the central portions 44*c*,46*c*,48*c*. The margin 76 can then be drawn away from the border portion 44*d* to separate the central portions 44*c*,46*c*,48*c* from the border portion 44*d* to a greater degree and enable access to the bottom ply 48 (see FIG. 6). The central portions 44*c*,46*c*,48*c* can also be completely detached from the border portion 44*d*.

In the illustrated embodiment, the central portion 48*c* of the bottom ply 48 provides an adhesive return label 126 that can be adhered to package P for returning the package P to the sender. With the central portions 44*c*,46*c*,48*c* removed, a user can bend the portions 44*c*,46*c*,48*c* along the line 66 so that a corner of the return label 126 can be turned up and grasped by the user (see FIG. 7). In this manner, the return label 126 can be removed from the remainder of portions 44*c*,46*c*,48*c* and then repositioned into adhesive engagement with a package, such as package P (see FIG. 8). The principles of the present invention are also applicable where the return label 126 is applied to a package other than the package which is received by the package recipient. Furthermore, the label 126 could be applied to a substrate other than a package. The illustrated label 126 includes indicia associated with a pre-paid return label, but could include other suitable indicia (e.g., indicia associated with a non-pre-paid return label). While the adhesive label 126 is preferably used as a return label, it is also within the ambit of the present invention to use the label 126 for other purposes.

In operation, the label system 30 is operable to efficiently apply labels 38 to multiple packages while minimizing label waste. The label roll 36 dispenses the continuous web 42 of labels 38 into the print heads by unrolling an endmost label 38 from overlaid engagement with underlying labels. The illustrated labels 38 include no pre-printed indicia, although some pre-printed indicia may be included on the web 42 prior to printing with the station 34.

As the labels 38 shifted through the print heads 108,110 toward the applicator pad 124, indicia 78,80 is printed on top and bottom faces 44*a*,48*b*. The printed labels 38 are separated from the web 42 and received by the bottom surface of the pad 124. Once the border portions 46*d*,48*d* are removed from the label 38 and the package P is generally in or adjacent to the labeling position, the pad 124 moves with the label 38 from the retracted position to the extended position so that the label 138 is adhered to the package P. Preferably, the conveyor 120 continuously moves the package P in the indicated direction as the label 38 is applied to the package P. Again, it is also within the scope of the present invention where the conveyor 120 momentarily stops the package P for label application. The border portion 44*d* secures the label 38 to the package P using the top adhesive layer 54 so that the bottom indicia 80 is hidden by the label 38 and package P in a secured label configuration. In addition, the top face 44*a* is exposed to permit viewing and electronic scanning of indicia 78.

The bottom ply 48 and bottom indicia 80 are exposed by first removing the tear strip 74 from the top ply 44 to present the unsupported margin 76. The recipient can then grasp the exposed margin 76 to remove the central portions 44*c*,46*c*, 48*c* from the border portion 44*d*. By exposing the bottom ply 48, the return label 126 can be removed from central portions 44*c*,46*c*. The removed return label 126 can then be repositioned in adhesive engagement with package P.

Turning to FIGS. 9-25, alternative preferred embodiments of the present invention are depicted. For the sake of brevity, the remaining description will focus primarily on the differences of these alternative embodiments from the preferred embodiment described above.

Figure 9:
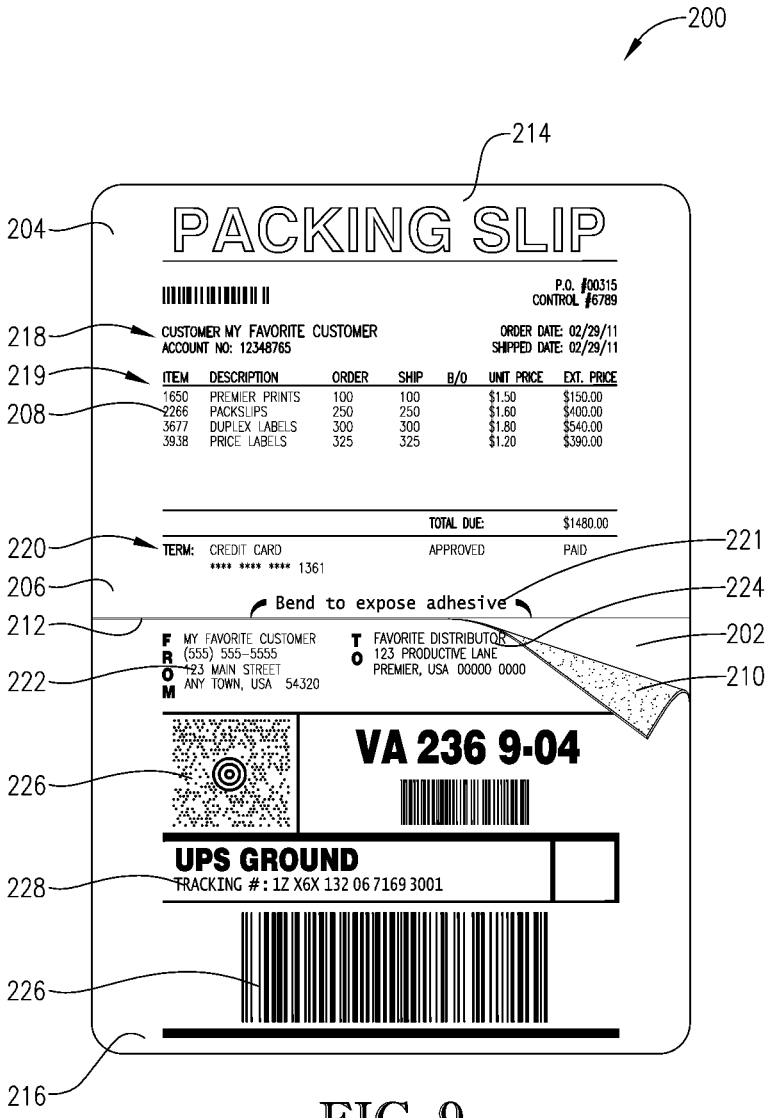
FIG. 9 is a fragmentary top view of a multiple-ply label constructed in accordance with a second preferred embodiment of the present invention, showing middle and bottom plies of the label, with a central portion of the bottom ply having a die cut line that divides the central portion into a pair of sections that provide a packing slip and return label.

Initially turning to FIG. 9, an alternative label 200 includes a top ply (not shown), a middle ply 202, and an alternative bottom ply 204. The bottom ply 204 includes a border portion (not shown) and an alternative central portion 206 with bottom indicia 208 printed thereon. The bottom ply 204 is removably adhered to the middle ply 202 by a bottom adhesive layer 210. The central portion 206 includes a die cut line 212 that extends between side edges of the central portion 206 and divides the central portion 206 into a packing slip section 214 and a return label section 216, with the sections 214,216 having about the same shape.

The packing slip section 214 presents some of the bottom indicia 208, including purchase order indicia 218 that includes a purchase order number, control number, customer account number, and order and ship dates of the purchase, package contents and billing indicia 219 that provides an itemized list of the package contents, the cost of each item listed alongside the corresponding item, the total cost, credit card indicia 220 including part of the customer's credit card number, and instruction indicia 221. The return label section 216 presents another portion of the bottom indicia 208, including return sender address indicia 222, return recipient address indicia 224, bar code indicia 226, and tracking number indicia 228.

The die cut line 212 serves to provide user access to adjacent edges of the packing slip and return label sections 214, 216. In particular, the user can bend the central portions of the label 200 along the die cut line 212 so that a corner of the sections 214,216 can be pulled away from the middle ply 202.

Figure 10:
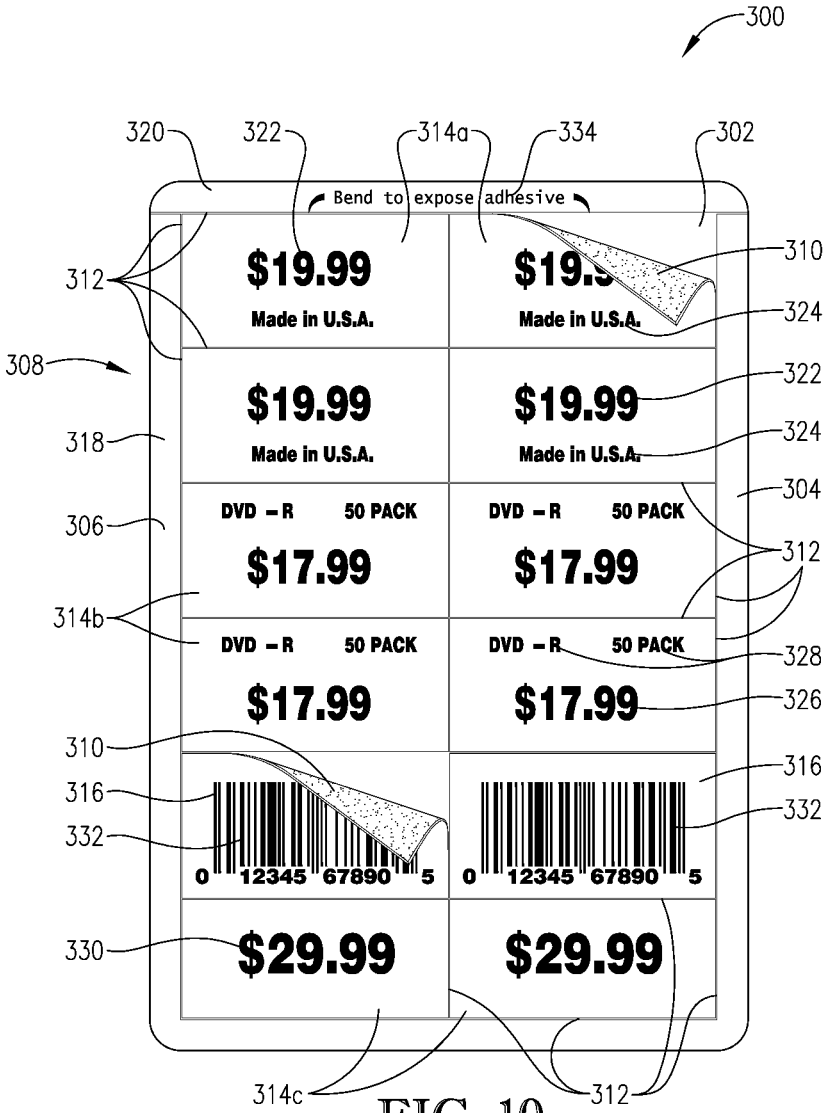
FIG. 10 is a fragmentary top view of a multiple-ply label constructed in accordance with a third preferred embodiment of the present invention, showing middle and bottom plies of the label, with a central portion of the bottom ply having a plurality of die cut lines that divide the central portion into multiple sticker sections that provide price stickers and bar code stickers.

Turning to FIG. 10, an alternative label 300 includes a top ply (not shown), a middle ply 302, and an alternative bottom ply 304. The bottom ply 304 includes a border portion (not shown) and an alternative central portion 306 with bottom indicia 308 printed thereon. The bottom ply 304 is removably adhered to the middle ply 302 by bottom adhesive layer 310. The central portion 306 includes multiple die cut lines 312 that cooperatively divide the central portion 306 into a plurality of price stickers 314*a,b,c*, bar code stickers 316, and outer margin sections 318,320.

The price stickers 314*a* present price indicia 322 and description indicia 324. Price stickers 314*b* present price indicia 326 and information indicia 328. Price stickers 314*c* present price indicia 330. The bar code stickers 316 present bar code indicia 332. Outer margin section 320 presents instruction indicia 334.

The die cut lines 312 provide user access to edges of corresponding stickers and outer margin sections. In particular, the user can bend the central portions of the label 300 along the die cut lines 312 so that a corner of an adjacent sticker 314,316 can be pulled away from the middle ply 302.

Figure 11:
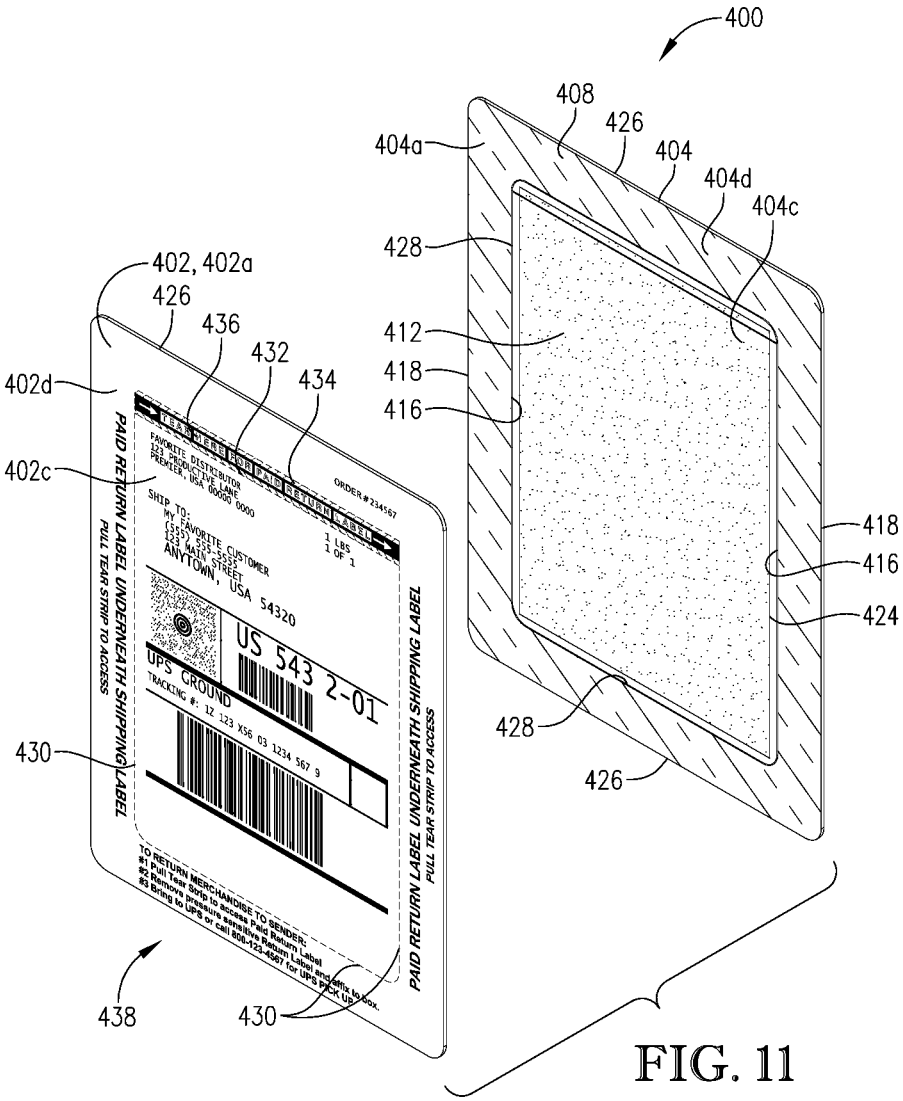
FIG. 11 is an exploded top perspective of a multiple-ply label constructed in accordance with a fourth preferred embodiment of the present invention, showing top and bottom plies of the label and the top face of the bottom ply receiving a bottom release coating and a bottom adhesive layer.
Figure 12:
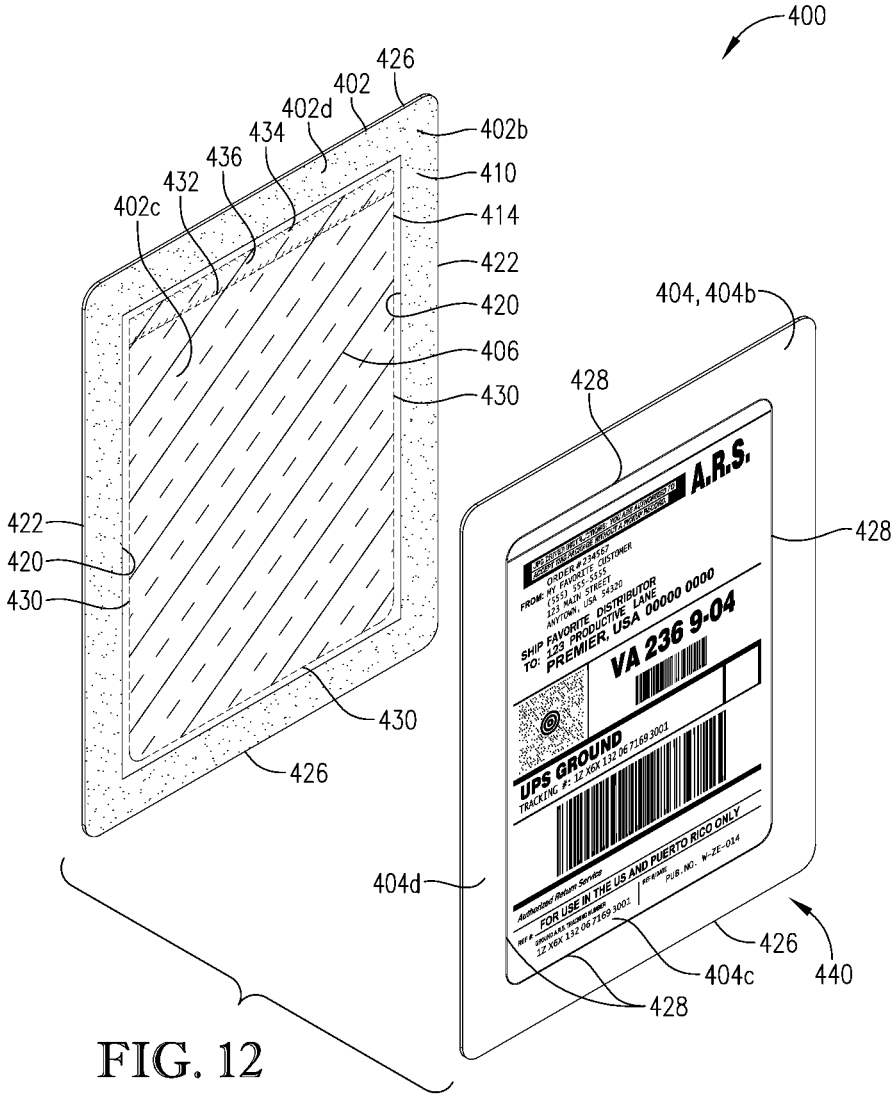
FIG. 12 is an exploded bottom perspective of the multiple-ply label shown in FIG. 11, showing the bottom face of the top ply receiving a top release coating and a top adhesive layer.
Figure 13:
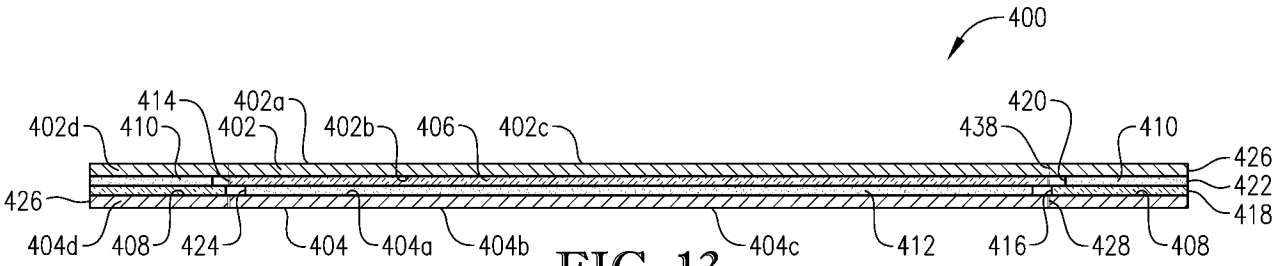
FIG. 13 is a cross section of the multiple-ply label shown in FIGS. 11 and 12, showing the plies removably adhered to one another by the adhesive layers.

Turning to FIGS. 11-13, an alternative multiple-ply label 400 is configured for use as a combination shipping and return label. However, the label 400 could present alternative indicia without departing from the scope of the present invention. The multiple-ply label 400 broadly includes top and bottom plies 402,404, top and bottom overlying release coatings 406,408, and top and bottom adhesive layers 410,412.

The plies 402,404 preferably present top faces 402*a*,404*a* and bottom faces 402*b*,404*b*. The top face 402*a* of the top ply 402 and the bottom face 404*b* of the bottom ply 404 are preferably printable by direct-thermal printing methods. However, the principles of the present invention are equally applicable where the label 400 is configured to be printed using another printing method, e.g., thermal transfer printing, laser printing, ink jet printing, or a combination of these printing methods.

The release coatings 406,408 permit the plies 402,404 to be removably adhered to one another, as will be discussed. The top release coating 406 is preferably applied in a continuous layer on the bottom face 402*b* of the top ply 402 so as to form a central release pattern that preferably covers a central portion 402*c* of the top ply 402, with the pattern defining an outer central release margin 414. The bottom release coating 408 is preferably applied in a continuous layer on the top face 404*a* of the bottom ply 404 so as to form an endless outer border release pattern, with the pattern defining inner and outer border release margins 416,418.

For some aspects of the present invention the label 400 could be devoid of one or both release coatings. For instance, the adhesive layers 410,412 could be comprised of a temporary adhesive that permits removal of the plies 402,404 from one another without the use of release coating.

The illustrated adhesive layers 410,412 serve to removably adhere the plies 402,404 to one another. The top adhesive layer 410 is preferably applied in a continuous layer on the bottom face 402*b* of the top ply 402 so as to form an endless outer border adhesive pattern, with the pattern defining inner and outer border adhesive margins 420,422. The bottom adhesive layer 412 is preferably applied in a continuous layer on the top face 404*a* of the bottom ply 404 so as to form a central adhesive pattern that extends across most of a central portion 404*c* of the bottom ply 404, with the pattern defining an outer central adhesive margin 424.

The adhesive layers 410,412 preferably removably adhere the top and bottom plies 402,404 to each other. Preferably, the illustrated top adhesive layer 410 extends so that the outer border adhesive margin 420 extends along label outer edges 426 when the plies are adhered in registration with each other. With respect to the top adhesive layer 410, this construction reduces the risk of inadvertent label removal (e.g., during shipping). However, the principles of the present invention are applicable where one or more of the plies 402,404 extend outwardly from the top adhesive layer 410 (e.g., to provide an outer adhesive-free part of the label 400).

The plies 402,404 preferably include central portions 402*c*, 404*c* and border portions 402*d*,404*d*. The illustrated border portions 402*d*,404*d* preferably extend endlessly about the respective central portions 402*c*,404*c*, although the border portions 402*d*,404*d* could have an alternative configuration (e.g., border portion 402*d* could be separated into two sections by a tear strip that extends from one label outer edge 426 to an opposite label outer edge 426). The top ply 402 preferably has the top adhesive layer 410 applied along the bottom face 402*b* so that the inner border adhesive margin 420 is positioned outwardly from the central portion 402*c* of the top ply 402. Also, the bottom ply 404 preferably has the bottom adhesive layer 412 applied along the top face 404*a* so that the outer central adhesive margin 424 is positioned inwardly from the edges of the central portion 404*c* of the bottom ply 404.

The illustrated adhesive layers 410,412 preferably comprise a permanent adhesive so that the label 400 is tamper-evident. However, according to some aspects of the present invention, the adhesive layers 410,412 could alternatively comprise a temporary adhesive.

The bottom ply 404 includes an endless line of separation 428 that extends along four sides of the ply 404. The bottom ply 404 also includes an end line of separation 430 positioned adjacent one end of the bottom ply 404. The lines of separation 428,430 preferably comprise die cut lines, but it is also within the scope of the present invention where the lines of separation 428,430 include a perforation line. Preferably, the endless lines of separation 428 extend between and thereby define central and border portions 404*a,b* of the bottom ply 404, with the central portion 404*a* being removable from the border portion 404*b*.

The top ply 402 further includes side perforation 430 that extends along three sides of the top ply 402 and end perforations 432,434. Preferably, the perforations 430,434 extend between and thereby define central and border portions 402*c,d* of the top ply 402, with the central portion 402*c* being entirely removable from the border portion 402*d*. However, for some aspects of the present invention, the central portion 402*c* may not be defined by perforations (e.g., where the label 400 is devoid of perforations).

Perforations 432,434 extend along the central portion 402*c* between ends of side perforation 430, and perforation 432 is inwardly spaced from and adjacent to perforation 434. Perforations 430,432,434 cooperatively define a tear strip 436 of the central portion 402*c* that connects portions of the top ply 402 to one another. The illustrated tear strip 436 is removable to present an unsupported margin of the central portion adjacent an end of the top ply 402.

The printed label includes top and bottom indicia 438,440, similar to top and bottom indicia 78,80, printed respectively on the top face 402*a* of the top ply 402 and the bottom face 404*b* of the bottom ply 404. As with the first-mentioned embodiment, the indicia 438,440 may include variable indicia and non-variable indicia.

The illustrated label 400 preferably includes discrete plies 402,404 that are removably adhered to one another. However, for some aspects of the present invention, the plies 402,404 could be attached to one another at one end thereof along a fold line (i.e., where stock is folded onto itself to form the two plies).

The printed label 400 can be adhered to package P by removing the border portion 404*d* of bottom ply 404. In particular, the top adhesive layer 410 and bottom release coating 408 permit removal of the border portion 404*d*. As with the first embodiment, removal of the illustrated border portion 404*d* can be done automatically (e.g., by a print and apply station) or manually.

The central portions 402*c*,404*c* of the adhered label 400 are removable from the border portion 402*d* of the top ply 402 by initially separating the tear strip 436 from the border portion 402*d*. Again, the tear strip 436 can be either partly or completely removed, and this separation of the tear strip 436 leaves the label 400 in an unsecured configuration where the bottom indicia 440 is no longer securely concealed. The unsupported margin of the central portions 402*c*,404*c* is exposed to permit the user to grab the central portions 402*c*, 404*c*. The margin can then be drawn away from the border portion 402*d* to separate the central portions 402*c*,404*c* from the border portion 402*d* to a greater degree and enable access to the bottom ply 404. The central portions 402*c*,404*c* can also be completely detached from the border portion 402*d*. In the illustrated embodiment, the central portion 404*d* of the bottom ply 404 serves as a return label that can be adhered to package P for returning the package P to the sender.

Turning to FIGS. 14-16, an alternative multiple-ply label 500 is configured for use as a combination shipping and return label. The description of this label 500 will focus primarily on the differences of this alternative embodiment from the label 400 described above. While the illustrated label is preferably a shipping and return label, the label 500 could present alternative indicia without departing from the scope of the present invention. The multiple-ply label 500 broadly includes top and bottom plies 502,504, top and bottom overlying release coatings 506,508, and top and bottom adhesive layers 510, 512. The plies 502,504 present top faces 502*a*,504*a* and bottom faces 502*b*,504*b*.

The top release coating 506 is preferably applied in the form of a series of longitudinally extending top release strips 506 on the bottom face 502*b* of the top ply 502. The top release strips are laterally spaced apart from one another. Similarly, the bottom release coating 508 is preferably applied in the form of a series of longitudinally extending bottom release strips 508 on the top face 504*a* of the bottom ply 504. The bottom release strips 508 are also laterally spaced apart from one another. Furthermore, the top release strips 506 are preferably laterally offset from the bottom release strips 508 when the top and bottom plies 502,504 are adhered in registration with one another.

For some aspects of the present invention the label 500 could be devoid of one or both release coatings 506,508. For instance, the adhesive layers 510,512 could be comprised of a temporary adhesive that permits removal of the plies 502, 504 from one another without the use of release coating.

The top adhesive layer 510 is preferably applied in the form of a series of longitudinally extending top adhesive strips 510 on a bottom face 502*b* of the top ply 502. The top adhesive strips 510 are laterally spaced apart from one another. Preferably, the top release and adhesive strips 506,510 are arranged so as to alternate in a lateral direction across the top ply 502. The bottom adhesive layer 512 is preferably applied in the form of a series of longitudinally extending bottom adhesive strips 512 on a top face 504*a* of the bottom ply 504. The bottom adhesive strips 512 are laterally spaced apart from one another. Preferably, the bottom release and adhesive strips 508,512 are arranged so as to alternate in a lateral direction across the bottom ply 504.

The top adhesive strips 510 are preferably laterally offset from the bottom adhesive strips 512 when the top and bottom plies 502,504 are adhered in registration with one another. Furthermore, the top adhesive strips 510 are preferably spaced apart from the bottom adhesive strips 512 when the plies are adhered. Also, the release strips 506,508 are preferably in overlying engagement with corresponding adhesive strips 510,512. In this manner, the plies 502,504 are removably adhered with one another.

The plies 502,504 preferably include central portions 502*c*, 504*c* and border portions 502*d*,504*d*. Central and border portions 502*c,d* are preferably defined by perforation lines. Central and border portions 504*c,d* are preferably defined by die cut lines. Preferably, the release and adhesive strips on each ply extend along both of the central and border portions of that ply.

The illustrated label 500 preferably includes discrete plies 502,504 that are removably adhered to one another. However, for some aspects of the present invention, the plies 502,504 could be attached to one another at one end thereof along a fold line (i.e., where stock is folded onto itself to form the two plies).

Turning to FIGS. 17 and 18, description of an alternative multiple-ply label 600 will focus primarily on the differences of this alternative embodiment from the label 38 described above. The alternative multiple-ply label 600 broadly includes top ply 602, middle ply 604, bottom ply 606, top and bottom adhesive layers 608,610, and a top release coating 612. Each of the plies 602,604,606 preferably present opposite top and bottom faces. The top face of the top ply 602 and the bottom face of the bottom ply 606 are preferably printable by direct-thermal printing methods. However, the principles of the present invention are equally applicable where the label is configured to be printed using another printing method, e.g., thermal transfer printing, laser printing, ink jet printing, or a combination of these printing methods.

The release coating 612 permits the top and middle plies 602,604 to be removably adhered to one another. The top release coating 612 is preferably applied in a continuous layer on the top face of the middle ply 604 so as to cover the entire top face of the middle ply 604. The label 600 is preferably devoid of any release coating between the middle and bottom plies 604,606.

The top adhesive layer 608 is preferably applied in a continuous layer on the bottom face of the top ply 602 so as to cover the entire bottom face of the top ply 602. Thus, the top adhesive layer 608 and top release coating 612 cooperatively removably adhere the top and middle plies 602,604 to one another.

The bottom adhesive layer 610 is preferably applied in a continuous layer on the top face of the bottom ply 606 so as to cover the entire top face of the bottom ply 606. The principles of the present invention are also applicable where the adhesive layers 608,610 are patterned.

The illustrated adhesive layers 608,610 preferably comprise a permanent adhesive. Thus, the bottom adhesive layer 610 serves to permanently adhere the middle and bottom plies 604,606 to one another. Consequently, a central portion 606*c* of the bottom ply 606 is not removable from the middle ply 604 to permit adhesive repositioning of the central portion 606*c* on a substrate (e.g., where the central portion 606*c* is applied to the package P as a return label).

The middle and bottom plies 604,606 each include die cut lines 614 that extend along four sides of the plies. The die cut lines 614 extend between and thereby define central and border portions 604*c,d* of the middle ply and central and border portions 606*c,d* of the bottom ply, with the central portions being removable from the respective border portions.

The top ply 602 further includes central and border portions 602*c,d* defined by perforations, with the central portion 602*c* being entirely removable from the border portion 602*d*. The perforations also cooperatively define a tear strip 618 of the central portion 602*c* that connects portions of the top ply 602 to one another.

The printed label 600 includes top and bottom indicia 620,622 printed respectively on the top face of the top ply 602 and the bottom face of the bottom ply 604. The bottom indicia 622 is provided so that the central portions 604*c*,606*c* of the middle and bottom plies 604,606 provide a packing slip. The bottom indicia 622 includes purchase order indicia 624 with a purchase order number, control number, customer account number, and order and ship dates of the purchase, package contents and billing indicia 626 that provides an itemized list of the package contents, the cost of each item listed alongside the corresponding item, the total cost, and credit card indicia 628 including part of the customer's credit card number.

Turning to FIGS. 19-22, a label assembly 700 includes overlying and underlying labels 702,704 that each preferably have the same multiple-ply label construction as label 38. Thus, the labels 702,704 each include top, middle, and bottom plies 706,708,710, top and bottom overlying release coatings 712,714, and top and bottom adhesive layers 716, 718 (see FIGS. 19 and 20). For each label, the top face of the top ply 706 and the bottom face of the bottom ply 710 are preferably printable by direct-thermal printing methods. However, the principles of the present invention are equally applicable where the label is configured to be printed using another printing method, e.g., thermal transfer printing, laser printing, ink jet printing, or a combination of these printing methods.

The plies 706,708,710 preferably include central portions 706*c*,708*c*,710*c* and border portions 706*d*,708*d*,710*d*. The middle and bottom plies 708,710 each include an endless die cut line that extends along four sides of the plies. Preferably, the endless die cuts define central and border portions of the middle and bottom plies 708,710, with the central portions being removable from the respective border portion.

The central and border portions 706*c,d* are defined by perforations, with the central portion 706*c* being entirely removable from the border portion 706*d*. However, for some aspects of the present invention, the central portion 706*c* may not be defined by perforations (e.g., where the label 702,704 is devoid of perforations). The perforations also cooperatively define a tear strip 720 of the central portion 702*c* that connects portions of the top ply 702 to one another.

The underlying label 704 is printed and is adhered to the package P by removing the border portions of the middle and bottom plies 708,710 of the label 704. The overlying label 702 is then printed and the border portions of plies 708,710 of the overlying label 702 are removed so that the overlying label 702 can be preferably adhered to the underlying label 704. However, the principles of the present invention are applicable where the overlying label 702 is adhered to the package P or both the package P and underlying label 704. The labels 702,704 are preferably printed and adhered in an automated process by a print and apply station (e.g., by using the station 34). For instance, the labels 702,704 are preferably applied sequentially by the same station. However, it is also within the ambit of the present invention where the labels 702,704 are applied sequentially, but at respective print and apply stations.

Once the labels 702,704 are applied, the central portions 706*c*,708*c*,710*c* of the adhered overlying label 702 are removable by separating the tear strip 720 from the border portion 706*d*. Thus, separation of the tear strip 720 exposes the unsupported margin of the central portions 706*c*,708*c*, 710*c* and permits the user to grab and separate the central portions 706*c*,708*c*,710*c*. Again, the central portions 706*c*, 708*c*,710*c* can also be completely detached from the border portion 706*d*.

By separating the central portions 706*c*,708*c*,710*c* from the rest of the overlying label 702, the central portions 706*c*, 708*c*,710*c* of the underlying label 704 are preferably exposed. Thus, the tear strip 720 of the underlying label 704 can be accessed to permit separation by the user. Furthermore, separation of the tear strip 720 of the underlying label 704 permits the user to grab and separate central portions 706*c*,708*c*,710*c* of the underlying label 704.

While both of the labels 702,704 preferably comprise a three-ply label with the same construction as label 38, the principles of the present invention are applicable where one of the labels 702,704 has an alternative label construction. For instance, one of the labels 702,704 could comprise a single ply label with central and border portions. Additional features of one preferred single ply label are disclosed in U.S. patent application Ser. No. 12/950,644, filed Nov. 19, 2010, entitled LINERLESS PACKING AND SHIPPING LABEL SYSTEM, which is hereby incorporated by reference herein. Furthermore, one of the labels in the label assembly could include a two-ply label, such as one of the two-ply label embodiments disclosed above.

Turning to FIGS. 23-25, description of an alternative multiple-ply label 800 will focus primarily on the differences of this alternative embodiment from the label 38 described above. The alternative multiple-ply label 800 broadly includes top, middle, and bottom plies 802,804,806, top and bottom overlying release coatings (not shown), and top and bottom adhesive layers (not shown).

The top and bottom plies 802,806 each preferably include central portions 802*c*,806*c* and border portions 802*d*,806*d*. The middle ply 804 also includes central portion 804*c* and border portion (not shown). The central and border portions of the middle and bottom plies 804,806 are preferably defined by endless die cut lines 808, with the central portions 804*c*, 806*c* being removable from the respective border portions 804*d*,806*d*.

The top ply 802 further includes central and border portions 802*c,d* that are defined by side perforation 810 and end perforations 812,814, with the central portion being entirely removable from the border portion. The perforations also cooperatively define a tear strip 816 of the central portion 802*c* that connects portions of the top ply 802 to one another. An end portion 818 of the endless die cut lines 808 is preferably longitudinally spaced between end perforations 812,816 when the plies 802,804,806 are adhered in registration with each other.

The label 800 is printed and is adhered to a package by removing the border portions of the middle and bottom plies 804,806. Once the label 800 is applied, the central portions of the label 800 are removable by separating the tear strip 816 from the border portion. With the tear strip 816 removed, an exposed end margin 820 of the middle and bottom plies 804,806 project longitudinally from an adjacent end margin 822 of the top ply 802 (see FIG. 25). Furthermore, the exposed end margin 820 and the border portion 802*d* cooperatively define an opening 824 that provides enhanced access to the exposed end margin 820. Thus, the exposed end margin 820 provides a tab that permits a user to readily grab and separate the central portions 802*c*,804*c*,806*c*.

While the illustrated label 800 is preferably a three-ply label, it is also within the scope of the present invention where the label 800 includes only top and bottom plies. For instance, the label could include the illustrated top and bottom plies 802,806, with patterned adhesive and release layers to removably adhere the plies to one another (e.g., using the patterned release and adhesive layers of label 400 or label 500).

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A label operable to be adhesively applied to a substrate to carry publicly displayed indicia on one side and hidden indicia on a second, opposite side, said label comprising:

unfolded top and bottom label plies, with each ply including top and bottom faces and a face outer edge, with the bottom face of the top label ply and the top face of the bottom label ply being opposed when the label plies are adhered relative to each other, said top label ply having the publicly displayed indicia printed thereon, said bottom label ply including a line of separation located inboard of the face outer edge to present a removable central portion, with the central portion of the bottom label ply having the hidden indicia printed thereon, said bottom label ply further including a removable border portion defined between the face outer edge and the line of separation, said bottom face of the top label ply including a top adhesive region, with a top adhesive layer being applied along the top adhesive region and the bottom label ply being in overlying relationship with the top adhesive layer when the label plies are adhered relative to each other to permit selective exposure of the top adhesive layer for adhesion of the top label ply, said top face of the bottom label ply including a bottom adhesive region, with a bottom adhesive layer being applied along the bottom adhesive region and the top label ply being in overlying relationship with the bottom adhesive layer when the label plies are adhered relative to each other to permit selective exposure of the bottom adhesive layer for adhesion of the bottom ply;

a top overlying release coating being applied in overlying relationship with the top adhesive layer when the plies are adhered relative to each other; and a bottom overlying release coating being applied in overlying relationship with the bottom adhesive layer when the plies are adhered relative to each other.

2. The label as claimed in claim 1;

an intermediate liner ply interleaved between the label plies, with the intermediate liner ply including top and bottom faces and a face outer edge, said top overlying release coating being applied to the top face of the intermediate liner ply, said bottom overlying release coating being applied to the bottom face of the intermediate liner ply.

3. The label as claimed in claim 2, said liner ply including a liner line of separation located inboard of the liner face outer edge to present a liner removable central portion, said liner ply further including a liner removable border portion defined between the liner face outer edge and the liner line of separation.

4. The label as claimed in claim 3, said top label ply including a line of weakness defined therein and located inboard of the face outer edge to present a separable central portion, with the top label ply further including an outer separable border portion defined between the face outer edge and the line of weakness, said removable border portions of the bottom label ply and liner ply being removable from the top label ply to permit adhesion of the label along the separable border portion to the substrate to cover the hidden indicia.

5. The label as claimed in claim 3, said top label ply including a line of weakness defined therein and located inboard of the face outer edge to present a separable central portion, with the top label ply further including an outer separable border portion defined between the face outer edge and the line of weakness, said central portions of the label and liner plies being removable from the separable border portion to expose the hidden indicia, with the bottom adhesive layer permitting removal of the central portion of the bottom label ply from the liner ply and adhesion of the central portion of the bottom label ply to a surface.

6. The label as claimed in claim 2, said top adhesive layer extending continuously along substantially the entire bottom face of the top label ply, said bottom adhesive layer extending continuously along substantially the entire top face of the bottom label ply.

7. The label as claimed in claim 1, said label plies being adhered to one another by the adhesive layers situated between the bottom face of the top label ply and the top face of the bottom label ply, said adhesive layers each comprising a respective patterned adhesive layer, with the adhesive layers being spaced from each other.

8. The label as claimed in claim 7, said top face of the bottom label ply including a bottom adhesive-free region, with the top overlying release coating being applied along the bottom adhesive-free region, said bottom face of the top label ply including a top adhesive-free region, with the bottom overlying release coating being applied along the top adhesive-free region.

9. The label as claimed in claim 8, said top label ply including a line of weakness defined therein and located inboard of the face outer edge to present a separable central portion, with the top label ply further including an outer separable border portion defined between the face outer edge and the line of weakness, said separable border portion being superposed with the removable border portion when the border portions are fixed relative to one another.

10. The label as claimed in claim 9, said top patterned adhesive layer extending along the separable border portion, with the removable border portion being removable from top label ply to permit adhesion of the label along the separable border portion to the substrate to cover the hidden indicia.

11. The label as claimed in claim 10, said top patterned adhesive layer extending entirely along the separable border portion, with the top overlying release coating extending entirely along the removable border portion.

12. The label as claimed in claim 11, said separable central portion being superposed with the removable central portion when the central portions are fixed relative to one another.

said bottom patterned adhesive layer extending entirely along the removable central portion, with the bottom overlying release coating extending entirely along the separable central portion.

13. The label as claimed in claim 8, said top label ply including a line of weakness defined therein and located inboard of the face outer edge to present a separable central portion, with the top label ply further including an outer separable border portion defined between the face outer edge and the line of weakness, said separable central portion being superposed with the removable central portion when the central portions are fixed relative to one another.

14. The label as claimed in claim 13, said bottom patterned adhesive layer extending along the removable central portion, with the separable border portion being removable from the bottom label ply to permit adhesion of the removable central portion to a surface.

15. The label as claimed in claim 14, said bottom patterned adhesive layer extending entirely along the removable central portion, with the bottom overlying release coating extending entirely along the separable central portion.

16. The label as claimed in claim 1, said top label ply including a line of weakness defined therein and located inboard of the face outer edge to present a separable central portion, with the top label ply further including an outer separable border portion defined between the face outer edge and the line of weakness; and a top ply access located along an edge of the separable central portion and cooperating with the line of weakness to provide user access to the bottom face of the top label ply to facilitate removal of the removable central portion.

17. The label as claimed in claim 16, said top ply access comprising a removable tear strip that is removable from the separable central portion and extends along one end of the separable central portion, said tear strip and said separable central portion being separated by a common line of weakness so that removal of the tear strip permits removal of the separable central portion.

18. A label operable to be adhesively applied to a substrate to carry publicly displayed indicia on one side and hidden indicia on a second, opposite side, said label comprising:

unfolded top and bottom label plies and an intermediate liner ply interleaved between the label plies, with each ply including top and bottom faces and a face outer edge;

a first adhesive layer applied between the bottom face of the top label ply and the top face of the liner ply, with the top label ply having the publicly displayed indicia printed thereon;

a second adhesive layer applied between the top face of the bottom label ply and the bottom face of the liner ply;

a top overlying release coating being applied to the top face of the intermediate liner ply and being in overlying relationship with the first adhesive layer when the top label ply and liner ply are adhered relative to each other; and a bottom overlying release coating being applied to the bottom face of the intermediate liner ply and being in overlying relationship with the second adhesive layer when the bottom label ply and liner ply are adhered relative to each other, said top label ply including a line of weakness defined therein and located inboard of the face outer edge to present a separable central portion, with the top label ply further including an outer separable border portion defined between the face outer edge and the line of weakness, said bottom label ply and said liner ply each including a line of separation located inboard of the face outer edge to present a removable central portion, with the central portion of the bottom label ply having the hidden indicia printed thereon, said bottom label ply and said liner ply each further including a removable border portion defined between the face outer edge and the line of separation, said removable border portions being removable from the top label ply to permit adhesion of the label along the separable border portion to the substrate to cover the hidden indicia, said central portions of the label and liner plies being removable from the separable border portion to expose the hidden indicia.

19. The label as claimed in claim 18, said top adhesive layer extending continuously along substantially the entire bottom face of the top label ply.

20. The label as claimed in claim 18, said bottom adhesive layer extending continuously along substantially the entire top face of the bottom label ply.

21. The label as claimed in claim 18; and a top ply access located along an edge of the separable central portion and cooperating with the line of weakness to provide user access to the bottom face of the top label ply to facilitate removal of the removable central portion.

22. The label as claimed in claim 21, said top ply access comprising a removable tear strip that is removable from the separable central portion and extends along one end of the separable central portion, said tear strip and said separable central portion being separated by a common line of weakness so that removal of the tear strip permits removal of the separable central portion.

* * * * *